US008493303B2

(12) United States Patent
Furihata et al.

(10) Patent No.: US 8,493,303 B2
(45) Date of Patent: Jul. 23, 2013

(54) LIQUID CRYSTAL DISPLAY DEVICE AND CONTROL DRIVER FOR A LIQUID CRYSTAL DISPLAY DEVICE

(75) Inventors: Hirobumi Furihata, Kanagawa (JP); Takashi Nose, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 807 days.

(21) Appl. No.: 12/213,968

(22) Filed: Jun. 26, 2008

(65) Prior Publication Data

US 2009/0009453 A1 Jan. 8, 2009

(30) Foreign Application Priority Data

Jul. 6, 2007 (JP) ..... 2007-178493

(51) Int. Cl.
*G09G 3/36* (2006.01)
*G09G 3/28* (2006.01)
*G09G 5/02* (2006.01)

(52) U.S. Cl.
USPC ..... 345/87; 345/89; 345/601

(58) Field of Classification Search
USPC ..... 345/1.1–2.3, 87–90
See application file for complete search history.

(56) References Cited

U.S. PATENT DOCUMENTS

| | | | | |
|---|---|---|---|---|
| 5,153,724 | A * | 10/1992 | Miyoshi et al. | 348/706 |
| 5,198,940 | A * | 3/1993 | Nagasawa et al. | 386/308 |
| 6,292,263 | B1 * | 9/2001 | Norita et al. | 356/639 |
| 7,679,619 | B2 * | 3/2010 | Ooga et al. | 345/601 |
| 2003/0006951 | A1 * | 1/2003 | Ito | 345/89 |
| 2005/0111046 | A1 * | 5/2005 | Kurumisawa et al. | 358/3.06 |
| 2005/0253777 | A1 * | 11/2005 | Zehner et al. | 345/1.3 |

FOREIGN PATENT DOCUMENTS

| | | |
|---|---|---|
| JP | 5-64110 | 3/1993 |
| JP | 2001-238227 | 8/2001 |
| JP | 2005-135157 | 5/2005 |

* cited by examiner

*Primary Examiner* — Alexander Eisen
*Assistant Examiner* — Amit Chatly
(74) *Attorney, Agent, or Firm* — McGinn IP Law Group, PLLC

(57) ABSTRACT

A control driver for a liquid crystal display panel includes: an operation circuit, an LUT (Look-up Table), and a linear interpolation D/A converter. The operation circuit performs a certain operation on input image data to generate operation data, and outputs higher order bit data and lower order bit data of the operation data. The LUT includes a V-T (Voltage-Transmittance) characteristic of the liquid crystal display panel, and outputs first output data and second output data as display data based on the higher order bit data and the V-T characteristic. The linear interpolation D/A converter performs an linear interpolation operation and D/A conversion to generate output voltage supplied to the liquid crystal display panel in response to the first output data, the second output data and the lower order bit data.

25 Claims, 18 Drawing Sheets

| ADDRESS | FIRST LUT (j+ l bits) | SECOND LUT (j+ l bits) |
|---|---|---|
| 0 | 0-TH VT DATA | 1ST VT DATA |
| 1 | 1ST VT DATA | 2ND VT DATA |
| ... | ... | ... |
| $2^j-2$ | $(2^j-2)$-TH VT DATA | $(2^j-1)$-TH VT DATA |
| $2^j-1$ | $(2^j-1)$-TH VT DATA | $(2^j-1)$-TH VT DATA |

Fig. 9

63 64 65

| 10-BIT GRAYSCALE | | 8-BIT GRAYSCALE | | 6-BIT GRAYSCALE | |
|---|---|---|---|---|---|
| GRAYSCALE | VOLTAGE | GRAYSCALE | VOLTAGE | GRAYSCALE | VOLTAGE |
| 16 | 3.7 | 4 | 3.7 | 1 | 3.7 |
| 20 | 3.6 | 5 | 3.6 | | |
| 24 | 3.5 | 6 | 3.5 | | |
| 28 | 3.4 | 7 | 3.4 | | |
| 30 | 3.3 | 7.5 | 3.3 | | |
| 32 | 3.2 | 8 | 3.2 | 2 | 3.2 |

Fig. 12B

| ADDRESS | ODD NUMBER LUT (j+ 1 bits) | EVEN NUMBER LUT (j+ 1 bits) |
|---|---|---|
| 0 | 1ST VT DATA | 0-TH VT DATA |
| 1 | 3RD VT DATA | 2ND VT DATA |
| ... | ... | ... |
| $2^{(j-1)}-2$ | $(2^j-3)$-TH VT DATA | $(2^j-4)$-TH VT DATA |
| $2^{(j-1)}-1$ | $(2^j-1)$-TH VT DATA | $(2^j-2)$-TH VT DATA |

Fig. 13B

| ADDRESS | ODD NUMBER LUT (8 bits) | EVEN NUMBER LUT (8 bits) |
|---|---|---|
| 0 | 1ST VT DATA | 0-TH VT DATA |
| 1 | 3RD VT DATA | 2ND VT DATA |
| ... | ... | ... |
| 30 | 61ST VT DATA | 60-TH VT DATA |
| 31 | 63RD VT DATA | 62ND VT DATA |

Fig. 14B

| ADDRESS | ODD NUMBER LUT (8 bits) | EVEN NUMBER LUT (8 bits) |
|---|---|---|
| 0 | 1ST VT DATA | 0-TH VT DATA |
| 1 | 3RD VT DATA | 2ND VT DATA |
| 2 | 5TH VT DATA | 4-TH VT DATA |
| ... | ... | ... |
| 30 | 61ST VT DATA | 60-TH VT DATA |
| 31 | 63RD VT DATA | 62ND VT DATA |

LIQUID CRYSTAL DISPLAY DEVICE AND CONTROL DRIVER FOR A LIQUID CRYSTAL DISPLAY DEVICE

INCORPORATION BY REFERENCE

This application is based upon and claims the benefit of priority from Japanese patent application No. 2007-178493 filed on Jul. 6, 2007, the disclosure of which is incorporated herein in its entirety by reference.

BACKGROUND OF THE INVENTION

1. Field of the Invention

The present invention relates to a liquid crystal display device and a control driver for a liquid crystal display device.

2. Description of Related Art

A flat panel display has been widely spreading as a man-machine interface. Since being especially superior to other flat panel displays (for example, a plasma display panel) in terms of a manufacturing technology, a yield, and a cost, a liquid crystal display device is applied to various fields.

A liquid crystal panel provided with the liquid crystal display device has a characteristic called V-T (Voltage-Transmittance) characteristic. Liquid crystal molecules of a pixel in the liquid crystal panel respond to a voltage of a certain level or more and an orientation of the liquid crystal molecules changes. The V-T characteristic indicates a relationship between a voltage for changing the orientation of the liquid crystal molecules and an amount of light passing through the pixel according to the voltage. The liquid crystal panel has the V-T characteristic that is unique for each panel and is nonlinear. For this reason, an applied voltage to the liquid crystal panel is determined by a control driver having a D/A converter which generates a nonlinear drive voltage with respect to a value of an input grayscale data based on the unique V-T characteristic for the liquid crystal panel in a common liquid crystal display device. Since an input image data supplied from outside to the liquid crystal display device is often a data of a gamma value ($\gamma$=2.2) corresponding to the CRT (Cathode-Ray Tube), the D/A converter included in the control driver is generally set so as to have a display characteristic of the $\gamma$=2.2 for example.

In a typical liquid crystal display device, processing (hereinafter, referred to as gamma correction processing) for using respectively different gamma values for R(red), G(green), and B(blue) is sometimes performed in order to further improve a color tone of a display image. The typical liquid crystal display device includes a LUT (Look-up table: reference table) storing gamma characteristic (grayscale correction characteristic) data in a preceding step of the control driver in order to perform the gamma correction processing, and transfers image data converted from input image data by using the LUT to the control driver.

When the input image data is formed of 8 bits for example, the LUT of the liquid crystal display device is required to have the extended bit number such as 10 bits. This is required for preventing destruction of the data when the gamma correction processing is performed with referring to the LUT. Accordingly, in the typical liquid crystal display device, the LUT is included in a memory able to store data whose bit number is larger than the bit number of the input image data.

In this liquid crystal display device, techniques for suppressing increase of a memory capacity allocated to the LUT are known. For example, Japanese Laid-Open Patent Application JP-A-Heisei 5-64110 discloses a following technique. A display screen is divided into blocks and gamma correction data for every some blocks are stored in a plurality of LUTs. Image signals converted into digital signals by an A/D converter are input to the plurality of the LUTs, and image signals of the blocks whose gamma correction data doesn't exist are formed by an interpolation processing circuit including a coefficient addition circuit and an addition circuit.

In addition, for another example, Japanese Laid-Open Patent Application JP-P 2001-238227A (corresponding to U.S. Pat. No. 6,795,063B2) discloses a following technique. When an image is displayed by using elements having a nonlinear signal-brightness characteristic such as the liquid crystal display device, in adjusting the gamma characteristic and a white balance, a dynamic range corrected by digital data is set through a gain adjustment and an offset adjustment using an analog circuit. Accordingly, when correction by using the digital data is performed based on the Look-up table, increase of capacity of a memory used for data for correction can be suppressed by efficiently using all of the correction data.

In addition, for another example, Japanese Laid-Open Patent Application JP-P 2005-135157A (corresponding to US US2005111046 A1) discloses a following technique. An image processing circuit, an image display device and an image processing method for a grayscale correction can reduce a storage capacity of correction characteristic data. In the technique disclosed in JP-P 2005-135157A, grayscale correction characteristic data corresponding to the number of grayscales less than the number of grayscales of input image data is stored in first and second LUT storage sections. With reference to the first and second LUT storage sections, using a grayscale value of a pixel targeted for the grayscale correction processing as an input grayscale value, an output grayscale value corresponding to the input grayscale value and an output grayscale value corresponding to the input grayscale value adjoining it are obtained. The adjoining grayscale value means a grayscale value in a next upper level of a certain input grayscale value or a grayscale value in a next lower level of the certain input grayscale value. Then, an output grayscale value between the adjoining two output grayscale values is calculated by a linear interpolation and output grayscale values corresponding to all input grayscale values are obtained. Finally, a grayscale correction is performed for each pixel of input image data and corrected image data is output.

We have now discovered a following fact. In a liquid crystal display device, when gamma operation processing is performed, a gamma value of changed data is sometimes required to be changed depending on a contrast of displayed image and brightness around a display device. For this reason, it is required that a data conversion can be performed based on a plurality of the gamma values in the gamma operation processing for the input image data. Accordingly, when there is a plurality of the gamma values targeted to be changed, the same number of the LUTs as the number of the gamma values targeted to be changed are required to be installed. In order to install a plurality of the LUTs, a memory capacity able to store a plurality of the LUTs is required. When the plurality of the LUTs for performing the gamma correction processing is installed in a control driver, a problem of increasing a chip size occurs.

In addition, to realize the data conversion using a plurality of the gamma values targeted to be changed with suppressing an increase of the chip size in the control driver, it is required to employ one LUT to be included and to rewrite the LUT depending on a change of a gamma value of a displayed image. However, the rewriting of the LUT needs much time.

For this reason, it is sometimes hard to rewrite the LUT in real time based on a change of an environment where an electric device is used.

In addition, a typical LUT can be also applied to correction processing of the V-T characteristic (hereinafter, referred to as a V-T correction processing) determined by a control driver generating a nonlinear drive voltage.

However, since the gamma correction processing or the V-T correction processing by the LUT is configured with the larger bit number than the bit number of the input image data in order to prevent a destruction of data, subtractive color processing is required to be performed before converted image data is input to the control driver when the correction processing by the LUT is performed.

Furthermore, in above mentioned correction processing employing one LUT according to the typical liquid crystal display device, it is impossible to simultaneously perform the processing for converting input image data into image data suitable for the liquid crystal display device such as the gamma operation processing (or other image calculation processing) and the V-T correction processing for further adapting the converted image data to the respective V-T characteristics of the display panel. In addition, the typical control driver cannot provide data to the display panel without performing the subtractive color processing.

SUMMARY

The present invention seeks to solve one or more of the above problems, or to improve upon those problems at least in part. In one embodiment, a control driver for a liquid crystal display panel includes: an operation circuit configured to perform a certain operation on input image data to generate operation data, and output higher order bit data and lower order bit data of the operation data; an LUT (Look-up Table) configured to include a V-T (Voltage-Transmittance) characteristic of the liquid crystal display panel, and output first output data and second output data as display data based on the higher order bit data and the V-T characteristic; and a linear interpolation D/A converter configured to perform an linear interpolation operation and D/A conversion to generate output voltage supplied to the liquid crystal display panel in response to the first output data, the second output data and the lower order bit data.

In another embodiment, a liquid crystal display device includes: a liquid crystal display panel; and a control driver configured to drive the liquid crystal display panel. The control driver includes: an operation circuit configured to perform a certain operation on input image data to generate operation data, and output higher order bit data and lower order bit data of the operation data, an LUT (Look-up Table) configured to include a V-T (Voltage-Transmittance) characteristic of the liquid crystal display panel, and output first output data and second output data as display data based on the higher order bit data and the V-T characteristic, and a linear interpolation D/A converter configured to perform an linear interpolation operation and D/A conversion to generate output voltage supplied to the liquid crystal display panel in response to the first output data, the second output data and the lower order bit data.

The present invention performs corrections for changing input image data into data adapted to a display panel. In this case, regarding corrections able to be performed by using operational expressions, the corrections are performed by using an operation circuit. Meanwhile, regarding corrections hard to be performed by using operational expressions (for example, a correction regarding the V-T characteristic), the corrections are performed by using the LUT stored in a rewritable memory. For this reason, it is not required to prepare the LUT corresponding to the corrections performed in the operation circuit described above, and it can be realize a control driver having a small circuit size.

That is, the control driver according to the present invention corrects input image data to display data adapted to the display panel by multiplying one LUT corresponding to the V-T characteristic of the display panel by an operation changeable depending on various kinds of values such as a gamma operation using an operational expression. The correction able to be performed by using operational expressions and the correction performed by using the LUT are independent. For this reason, by performing various kinds of operations with using one kind of the LUT, various kinds of corrections can be performed without installing the LUTs for each of the various kinds of operations.

In addition, the control driver according to the present invention includes a configuration which can switch the operations in response to a switch signal when there is a need to change an operation executed by the operation circuit with respect to input image data. Accordingly, a condition in displaying an image (for example, a contrast) can be rapidly changed according to a change of a surrounding environment of the liquid crystal display device.

In addition, the LUT according to the present invention corresponds to the V-T characteristics for each of the display panel. Accordingly, by rewriting the LUT, output voltages adapted to a plurality of display panels can be output due to one control driver.

Furthermore, in the present invention, the bit number of data output from the operation circuit (gamma operation result data) is expanded to be larger than the bit number of the input image data. In the correction processing in the LUT, the linear interpolation is performed on two data corresponding to the expanded bit number. Consequently, in the present invention, display data can be provided to a data line drive circuit without performing the subtractive color processing.

BRIEF DESCRIPTION OF THE DRAWINGS

The above and other objects, advantages and features of the present invention will be more apparent from the following description of certain preferred embodiments taken in conjunction with the accompanying drawings, in which:

FIG. 9 is a table showing a level-voltage characteristic of a liquid crystal display panel according to the first invention;

FIG. 12B is a table exemplifying a configuration of VT data stored in the LUT in the third embodiment;

FIG. 13B is a view exemplifying a table of the LUT according to the third embodiment;

FIG. 14B is a view exemplifying a table of the LUT according to the third embodiment;

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

An embodiment according to the present invention will be described below referring to drawings. In an embodiment described below, an explanation on the present invention will be made by exemplifying a case where an image is displayed on a liquid crystal display panel by converting input image data corresponding to a certain gamma value into data corresponding to another gamma value. This does not mean that the present invention can be applied only to a gamma correction processing.

(First Embodiment)

Figure 1:
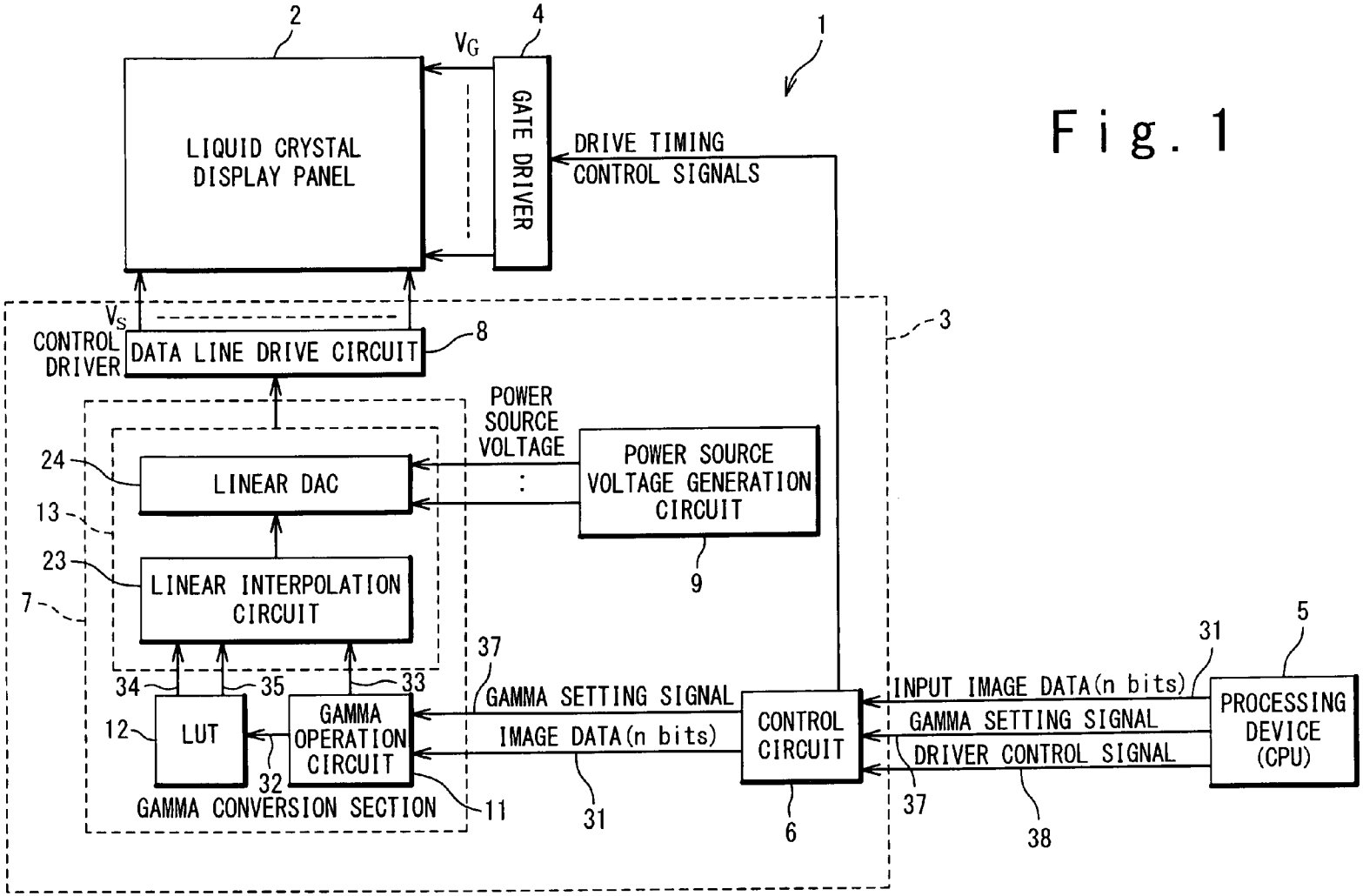
FIG. 1 is a block diagram exemplifying a configuration of a liquid crystal display device in the present invention.

FIG. 1 is a block diagram exemplifying a configuration of a liquid crystal display device 1 according to the present invention. Referring to FIG. 1, the liquid crystal display device 1 of the present embodiment includes a liquid crystal display panel 2, a control driver 3, a gate driver 4, and a processing device 5. The liquid crystal display panel 2 includes a plurality of data lines (not shown in the figure), the plurality of gate lines intersecting the plurality of the data lines (not shown in the figure), and a plurality of pixels (not shown in the figure) installed in the plurality of the intersection points. In addition, the liquid crystal display panel 2 includes back lights (not shown in the figure) providing transmitted light.

Each of the plurality of the pixels in the liquid crystal display panel 2 includes two pieces of polarizing plates and liquid crystals arranged therebetween. The liquid crystal molecules arranged in the pixels of the liquid crystal display panel 2 change their orientations based on strength of applied electric fields. The pixels transmit light according to directions of the orientations of the liquid crystal molecules. Accordingly, in the liquid crystal display device, image is displayed on the liquid crystal display panel 2 after input image data are corrected based on a relationship between the electric field applied to the pixel and the transmitted light transmitting the pixel (hereinafter, referred to as a V-T characteristic). The V-T characteristic differs from one individual of the liquid crystal display panel 2 to the next. That is, the V-T characteristic of one liquid crystal display panel 2 is different from that of other liquid crystal display panel 2.

The control driver 3 provides an output voltage to the data line. Details of the control driver 3 will be described later below. The gate driver 4 performs scanning of the gate lines (scanning lines). When the liquid crystal display panel 2 is driven with a non-interlace drive for example, the gate driver 4 subsequently scans the gate lines from an uppermost line. And, when scanning of a lowermost line is completed, the scanning returns to the uppermost line. The gate driver 4 repeatedly performs this operation.

The processing device 5 provides images displayed on the liquid crystal display panel 2 as input image data 31. The processing device 5 includes a CPU (not shown in the figure), a memory (not shown in the figure), an image memory (not shown in the figure), and a display controller (not shown in the figure). In addition, they are connected via busses (not shown in the figure). As shown in FIG. 1, the processing device 5 provides the input image data 31, a gamma setting signal 37, and a driver control signal 38 to the control driver 3.

Referring to FIG. 1, the control driver 3 of the first embodiment includes a control device 6, a gamma conversion section 7, a data line drive circuit 8, and a power source voltage generation circuit 9. In addition, the gamma conversion section 7 includes a gamma operation circuit 11, an LUT (Look-up Table) 12, and a linear interpolation D/A converter 13. The control device 6 receives the input image data 31, the gamma setting signal 37, and the driver control signal 38 supplied from the processing device 5. In addition, the control device 6 outputs a drive timing control signal for controlling drive timing of the gate driver 4. Furthermore, the control device 6 supplies the input image data 31 to the gamma conversion section 7 so as to correspond to operation timing of the gate driver 4. The data line drive circuit 8 drives data lines of the liquid crystal display panel 2 based on an output voltage provided from the gamma conversion section 7. Referring to FIG. 1, the linear interpolation D/A converter 13 includes a linear interpolation circuit 23 and a plurality of linear DAC (D/A Converter)s 24. The plurality of the linear DACs 24 is configured corresponding to the number of data lines of the liquid crystal display panel 2. As shown in FIG. 1, the power source voltage generation circuit 9 supplies a power source voltage to a plurality of the linear DACs 24 included in the linear interpolation D/A converter 13.

The gamma operation circuit 11 converts the input image data 31 corresponding to a certain gamma value into data (hereinafter, referred to as operation result data) corresponding to another gamma value (hereinafter, referred to as a changed gamma value). The LUT 12 refers to data in a table based on the operation result data provided from the gamma operation circuit 11. The LUT 12 of the present embodiment indicates the V-T characteristic of the liquid crystal display panel 2. In a following description, it is assumed that the LUT 12 corresponds to one of the R, G, and B in order to facilitate understanding of the present invention. The linear interpolation D/A converter 13 converts data into voltages based on a power source voltage supplied from the power source voltage generation circuit 9. More specifically, the linear interpolation D/A converter 13 generates the output voltage by performing the linear interpolation operation and the D/A conversion.

Figure 2:
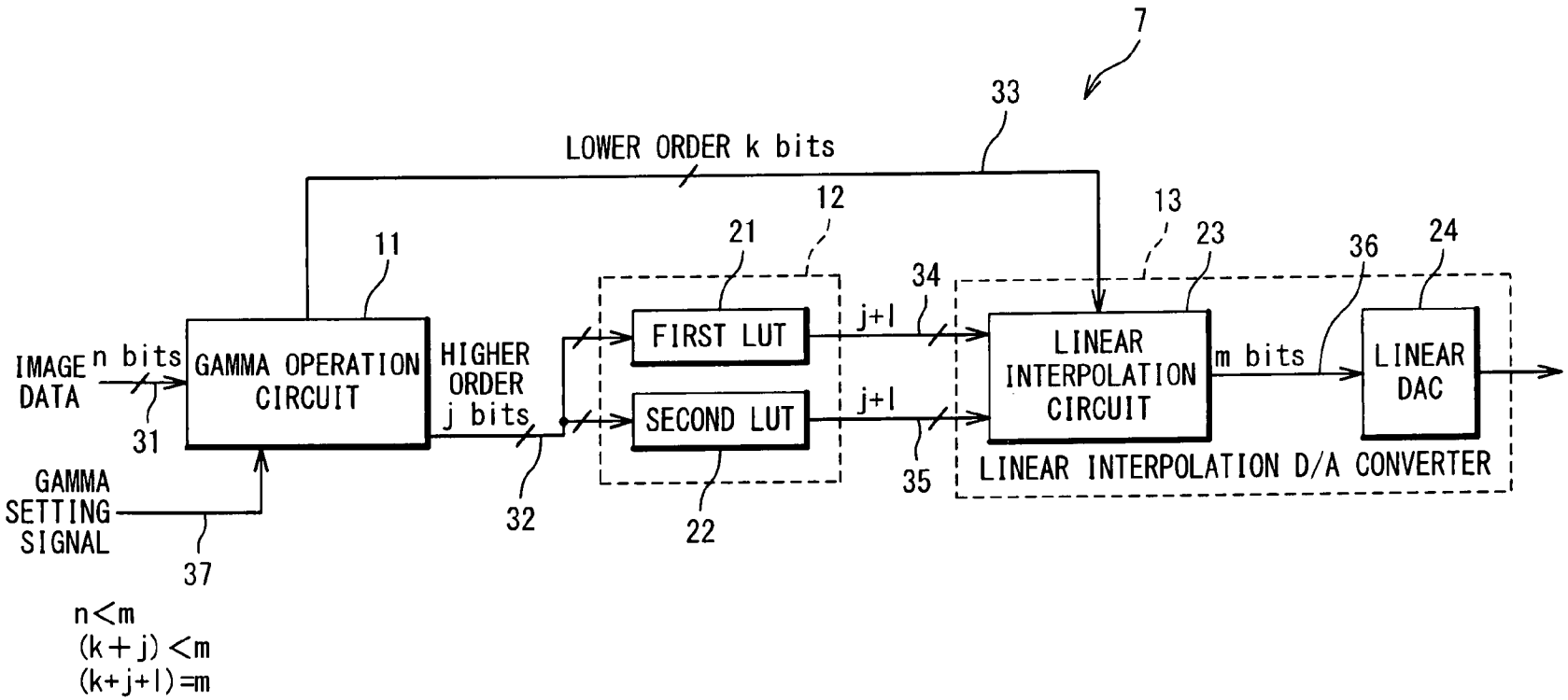
FIG. 2 is a block diagram exemplifying a configuration of a gamma conversion section according to a first embodiment.

Referring to drawings, a configuration of the gamma conversion section 7 according to the present embodiment will be explained below. FIG. 2 is a block diagram exemplifying a configuration of the gamma conversion section 7 according to the present embodiment. As described above, the gamma conversion section 7 includes the gamma operation circuit 11, the LUT (Look-up Table) 12, and the linear interpolation D/A converter 13. In addition, the linear interpolation D/A converter 13 according to the first embodiment includes the linear interpolation circuit 23 and the linear DACs 24.

Referring to FIG. 2, the input image data 31 is image data of a plurality of bits supplied from an outside of the control driver 3. The input image data 31 is configured with corresponding to a predetermined gamma value. As shown in FIG. 2, the gamma operation circuit 11 according to the present embodiment outputs higher order bit data 32 of j bits and lower order bit data 33 of k bits in response to the input image data 31 of n bits. The gamma operation circuit 11 provides the higher order bit data 32 to the LUT 12. The gamma operation circuit 11 provides the lower order bit data 33 to the linear interpolation circuit 23.

As shown in FIG. 2, the LUT 12 provides first output data 34 of (j+l) bits and second output data 35 of (j+l) bits to the linear interpolation circuit 23 in response to the higher order bit data 32. The linear interpolation circuit 23 outputs linear interpolation data 36 of m bits to the linear DAC 24 based on the lower order bit data 33, the first output data 34, and the second output data 35. The linear DAC 24 converts input data (linear interpolation data) into the voltage based on the power source voltage supplied from the power source voltage generation circuit 9.

In the present embodiment, the bit number "n" of the input image data 31, the bit number "j" of the higher order bit data 32, the bit number "k" of the lower order bit data 33, the bit number "j+l" of the first output data 34, the bit number "j+l" of the second output data 35, and the bit number "m" of the linear interpolation data 36 are not limited as far as following conditions are met. The conditions are:

$$n<m;$$

$$(k+j)<m; \text{ and}$$

$$(k+j+)=m.$$

In the present embodiment, the gamma operation circuit 11 performs above mentioned data conversion (hereinafter, referred to as gamma operation processing) without depending on the V-T characteristic of the liquid crystal display panel 2. Since the gamma operation circuit 11 performs the gamma operation processing without depending on the V-T characteristic of the liquid crystal display panel 2, the operation result data is uniquely determined when the changed gamma value is determined. Accordingly, the gamma operation circuit 11 according to the present embodiment can be configured by a circuit having a function for translating data into another data (for example, a combinational circuit).

As shown in FIG. 2, the gamma operation circuit 11 receives the input image data 31 supplied from an outside. The gamma operation circuit 11 performs the gamma operation processing for converting the input image data 31 into the operation result data when receiving the input image data 31. The gamma operation processing performed by the gamma operation circuit 11 will be explained below. The gamma operation circuit 11 performs the gamma operation processing for the input image data 31 based on a following expression (1).

$$(\text{Output data})=(\text{maximum value of output grayscale})\times((\text{input data})/(\text{maximum value of input data}))^{\text{gamma value }\gamma} \quad (1)$$

wherein the maximum value of output grayscale$=2^{k+j}-2^{((k+j)-n)}$, wherein k+j: the output bit number of the LUT 12, and (k+j)−n: the bit number for extension).

In changing the gamma of the input data here, changed data is destructed and becomes fewer kinds of output data than the input data when the input data and the output data have the same bit number. Accordingly, data destruction is prevented by executing bit extension on output data. For example, by executing 2-bit extension, data can be held without being destructed because the output data can have four times as much data as the input data.

In addition, since a value of the output data interpolates a value between two values among the input data, the number of interpolation portions is 255 when 256 grayscales are interpolated. The interpolation can be performed by using quadruple data in the case of the 2-bit extension, thus the number of output data can have 255×4=1020 kinds of data. For this reason, an expression of the maximum value of output grayscale is shown by above-mentioned expression.

An explanation will be made with using concrete values below. For example, it is assumed that the bit numbers of the input image data 31, the higher order bit data 32, and the lower order bit data 33 are 8 bits, 6 bits, and 4 bits, respectively. In this case, the gamma operation circuit 11 obtains following operation result data as a result of performing the gamma operation processing for the input image data 31.

$$(\text{The operation result data})=(2^{(4+6)}-2^{(4+6-8)})\times((\text{input image data})/2^{8})^{\text{gamma value }\gamma}$$

$$=(2^{10}-2^{2})\times((\text{input image data})/2^{8})^{\text{gamma value }\gamma}$$

$$=1020\times((\text{input image data})/255)^{\text{gamma value }\gamma}.$$

In addition, the gamma operation circuit 11 outputs higher order 6 bits of the gamma operation result data to the LUT 12 as the higher bit data 32. Furthermore, the gamma operation circuit 11 outputs lower order 4 bits of the gamma operation result data to the LUT 12 as the lower bit data 33.

The LUT 12 is formed of a memory able to rewrite stored data based on a command supplied from an outside of the control driver 3. In the embodiment described below, an explanation is made with exemplifying a case where the LUT 12 is formed of a RAM (Random Access Memory) Correction data, for example, showing a unique V-T characteristic of the liquid crystal display panel 2 is stored in the LUT 12. In addition, when the input image data 31 are for each of the R, G, and B, the LUT 12 is installed for each of the R, G, and B and each of the installed LUTs 12 is configured so as to perform independent correction. For example, when the input image data 31 are for the R color, the LUT 12 for the R color is used to perform the R color correction on the input image data 31 which is independent of the G and B color corrections.

Referring to FIG. 2, the LUT 12 according to the present embodiment is configured by including a first LUT 21 and a second LUT 22. Details of the LUT 12 will be described later.

The linear interpolation circuit 23 is a circuit for performing the linear interpolation for the first output data 34 and the second output data 35 based on a following expression (2). The expression (2) is:

$$\text{(The linear interpolation data 36)}=\text{(The first output data 34)}+(((\text{the second output data 35})-(\text{the first output data 34}))\times(\text{the lower order bit data 33}))/2^{\gamma\ conversion\ lower\ bit} \quad (2),$$

wherein (the first output data 34)<(the second output data 35), wherein (The γ conversion lower bit)=(the bit number of the lower order bit data 33 output from the gamma operation circuit 11).

For example, when the bit number of the lower order bit data 33 is 4 bits, the lower order bit data 33 is one of 15 values of 0 to 15 ("0000" to "1111") and the $2^{\gamma\ conversion\ lower\ bit}$ is 16.

The linear interpolation circuit 23 supplies this linear interpolation data 36 for the linear DAC 24. The linear DAC 24 converts input data (linear interpolation data) into a voltage based on a power source voltage supplied from the power source voltage generation circuit 9. In the linear DAC 24, the input linear interpolation data 36 and the output voltage are equally weighted (linear). That is to say, the weight of the data input to the linear DAC 24 and the weight of the voltage output from the linear DAC 24 are constant, and the linear DAC 24 has linearity on a relation between the input data and the output voltage. Accordingly, based on the lower order bit data 33 provided by the gamma operation circuit 11 and the linear interpolation data 36 provided by the linear interpolation circuit 23, the linear DAC 24 converts the linear interpolation data 36 into the output voltage by uniquely performing D/A conversion without depending on the V-T characteristic of the liquid crystal display panel 2. After converting the input linear interpolation data 36 into the voltage, the linear DAC 24 supplies the voltage to the data line drive circuit 8.

Figure 3:
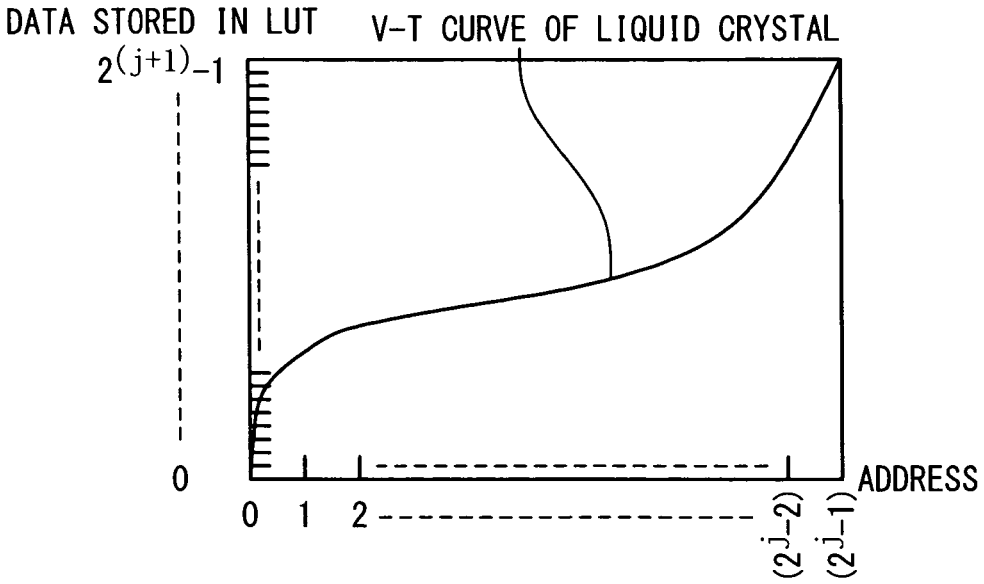
FIG. 3 is a graph showing a relation between an input and an output in a LUT according to the first embodiment.

An explanation of data stored in the LUT 12 will be made below. FIG. 3 is a graph showing a relation (correspondence) between input and output in correction data (hereinafter, referred to as VT data) stored in the LUT 12 according to the present embodiment. Referring to FIG. 3, the LUT 12 according to the present embodiment includes $2^j$ number of addresses (0 to $2^j-1$) corresponding to input higher order bit data 32. In each of the addresses, the VT data of (j+l) bits is stored.

The LUT 12 includes addresses, wherein the number of addresses corresponds to the bit number of the higher order bit data 32 supplied from the gamma operation circuit 11. When the gamma operation circuit 11 outputs the higher order bit data 32 of 6 bits for example, the LUT 12 includes 64 addresses corresponding to 6 bits which are the bit number thereof. In addition, the LUS 12 according to the present embodiment includes the VT data whose bit number is larger than the bit number of the input higher order bit data 32 for each of the addresses. In the present embodiment, it is assumed that the VT data of 8 bits (larger than 6 bits) is included for each of 64 addresses. Accordingly, a size of one LUT 12 is:

$$64\ \text{grayscales}\times 8\ \text{bits}=512\ \text{bits}.$$

Figure 4:
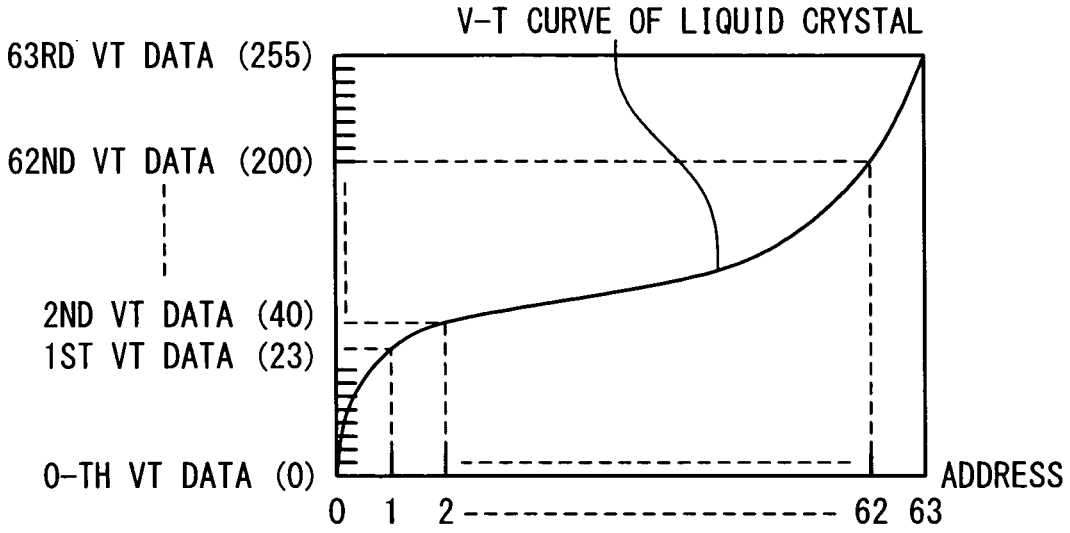
FIG. 4 is a graph showing an example of the relation between an input and an output in a LUT according to the first embodiment.

The VT data will be explained with using concrete values below. FIG. 4 is a graph showing a relation (correspondence) between input and output in a case where the bit number "j" of the higher order bit data 32 is 6 and where the bit number "j+l" of the first output data 34 and the bit number "j+l" of the second output data 35 are 8 (that is, l is 2) according to the present embodiment. Here, parenthetic numerals in the vertical axis show data values of the VT data.

Referring to FIG. 4, the LUT 12 outputs 0-th VT data when the input higher order bit data 32 shows "0". Similarly, the LUT 12 outputs the 1st VT data when the input higher order bit data 32 shows "1" and outputs the 2nd VT data when the input higher order bit data 32 shows "2". Similarly, data from 3rd VT data to 63rd VT data are output when the input higher order bit data 32 shows "3" to "63", respectively. That is, a data of 0-th VT data to 63rd VT data stored in addresses corresponding to values shown by the input higher order bit data 32 is output.

As described above, the LUT 12 in the present embodiment is configured by including a first LUT 21 and a second LUT 22. Each of the first LUT 21 and the second LUT 22 refers to VT data stored in each of their tables in response to the higher order bit data 32 supplied from the gamma operation circuit 11. The second LUT 22 stores the same data as data stored in n-th (n: arbitrary integer) address of the first LUT 21 in (n+1)-th address (or (n−1)-th address).

The LUT 21 outputs the VT data stored in the address indicated by the higher order bit data 32 as the first output data 34. The VT data of the address larger by 1 (or smaller by 1) than the address of the first LUT 21 is stored in the same address of the second LUT 22. For example, when the VT data of the first address of the first LUT 21 is "00000001", "00000001" is stored in 0-th address of the second LUT 21. Accordingly, the second LUT 22 outputs the VT data of the n-th address (VT data corresponding to (n+1)-th address or (n−1)-th address of the first LUT 21) as the second output data 35 based on the higher order bit data 32.

Figures 5A, 5B:
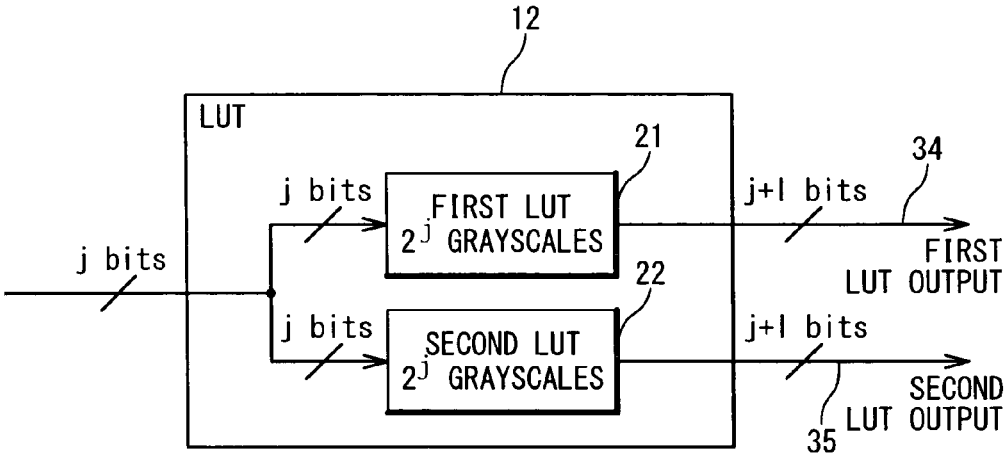
FIG. 5A is a view showing a configuration of the LUT according to the first embodiment.
FIG. 5B is a view showing a VT data stored in the LUT having a first LUT and a second LUT according to the first embodiment.

Referring to drawings, configurations of above mentioned first LUT 21 and second LUT 22 will be explained below. FIG. 5A is a view showing the configuration of the LUT 12 according to the present embodiment. FIG. 5B is a view showing the VT data stored in the LUT 12 having the first LUT 21 and the second LUT 22 according to the present embodiment. Referring to FIG. 5B, the first LUT 21 of the LUT 12 stores the 0-th VT data corresponding to the address "0". As shown in FIG. 5B, the second LUT 22 of the LUT 12 stores the 1st VT data corresponding to the address "0". The VT data corresponding to a 0-th address to a $(2^j-1)$-th address are:

| Address | the first LUT 21 | the second LUT 22; |
|---|---|---|
| "0" | 0-th VT data | 1st VT data; |
| "1" | 1st VT data | 2nd VT data; |
| "2" | 2nd VT data | 3rd VT data; |
| | . . . | |
| "$(2^j-2)$" | $(2^j-2)$-th VT data | $(2^j-1)$-th VT data; and |
| "$(2^j-1)$" | $(2^j-1)$-th VT data | $(2^j-1)$-th VT data, |

as shown in FIG. 5B. The LUT 12 outputs stored data in response to the data of higher order j bits.

When the LUT 12 is composed of one table, the LUT 12 obtains the first output data 34 with referring to the VT data corresponding to the address shown by the higher order bit data 32. On this occasion, the LUT 12 is assumed that the VT data adjoining the address shown by the higher order bit data 32 is the second output data 35. Then, the LUT 12 outputs the first output data 34 and the second output data 35 to the linear interpolation circuit 23.

Figure 6A:
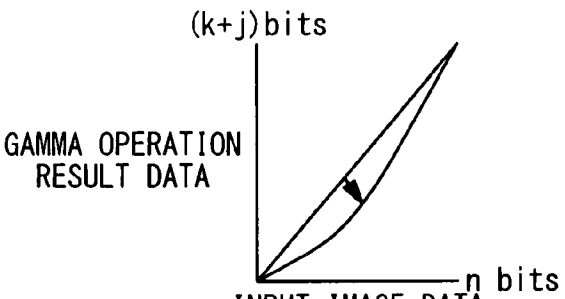
FIGS. 6A to 6C are views exemplifying an operation when input image data is provided to the gamma conversion section according to the first invention.
Figure 6B:
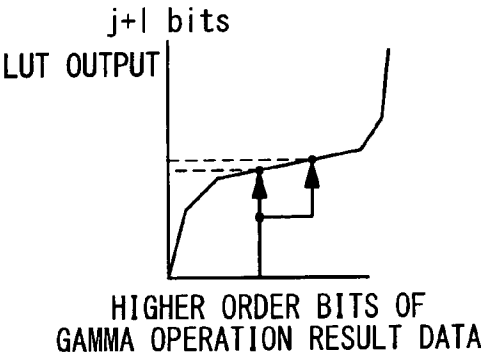
Figure 6C:
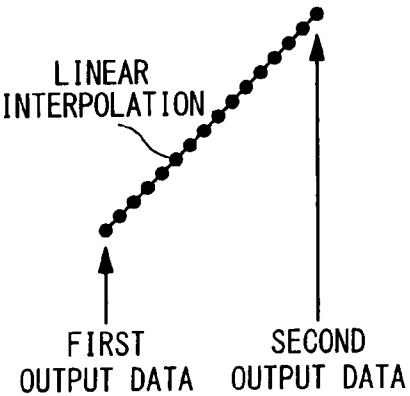

Referring to drawings, an operation of the gamma conversion section 7 having above-mentioned configuration will be explained below. FIGS. 6A to 6C are views exemplifying an operation when the input image data 31 is supplied for the gamma conversion section 7 according to the present invention. FIG. 6A exemplifies an operation of the gamma operation circuit 11. In FIG. 6A, the horizontal axis shows the input image data (n bits), and the vertical axis shows the gamma operation result data ((k+j) bits). FIG. 6B exemplifies an operation of the LUT 12. In FIG. 6B, the horizontal axis shows the higher order (j) bits of the gamma operation result data, and the vertical axis shows the LUT output (VT data) ((j+l) bits). FIG. 6C exemplifies an operation of the linear interpolation circuit 23 of the linear interpolation D/A converter 13.

As shown in FIG. 6A, the gamma operation circuit 11 outputs higher order 6 (j) bits of the gamma operation result data to the LUT 12 as the higher order bit data 32 and outputs lower order 4 (k) bits to the linear interpolation circuit 23 as the lower order bit data 33.

As shown in FIG. 6B, the LUT 12 refers to stored VT data in response to the higher order bit data 32 supplied from the gamma operation circuit 11 as described above. On this occasion, the first LUT 21 of the LUT 12 supplies the VT data stored in the address shown by the input higher order bits data 32 to the linear interpolation circuit 23 as the first output data 34. In addition, the second LUT 22 of the LUT 12 supplies the VT data stored in the address shown by the input higher order bits data 32 to the linear interpolation circuit 23 as the second output data 35. That is, two output data whose addresses adjoin each other are output to the linear interpolation circuit 23 based on the higher order bits data 32.

As shown in FIG. 6C, the linear interpolation circuit 23 performs linear interpolation between the first output data 34 and the second output data 35 supplied from the LUT 12 based on the lower order bit data 33. The linear interpolation circuit 23 supplies the linear interpolation data 36 that is the performance result to the linear DAC 24. The linear DAC 24 converts the linear interpolation data 36 into the voltage and supplies the voltage to the data line drive circuit 8.

As described above, the gamma operation circuit 11 according to the present embodiment converts the input image data 31 corresponding to a certain gamma value into data corresponding to another gamma value (gamma operation result data). And, the gamma operation circuit 11 outputs higher order j bits of the gamma operation result data to the LUT 12 as the higher order bit data 32. In the LUT 12, the higher order bit data 32 is supplied to the first LUT 21 and the second LUT 22. The first LUT 21 outputs the first output data 34 in response to the higher order bit data 32. Similarly, the second LUT 22 outputs the second output data 35 in response to the higher order bit data 32. The linear interpolation can be performed on the two data (34 and 35). For this reason, the two data (34 and 35) are supplied to the linear interpolation circuit 23 of the linear interpolation D/A converter 13. The linear interpolation circuit 23 performs the linear interpolation on the two data (34 and 35) with using the lower order bit data 33.

In this case, the gamma operation circuit 11 includes a function for changing the changed gamma value depending on an environment where the liquid crystal display device 1 is used. The gamma operation circuit 11 performs the gamma operation for adapting to a plurality of gamma characteristic in response to the gamma setting signal 37. FIGS. 7A, 7B, 8A and 8B are views specifically exemplifying above-mentioned operation. To facilitate understanding of the present invention, the present embodiment will be explained below with reference to two cases. The first case is that the gamma value of the input image data 31 is not changed. The second case is that the gamma value of the input image data 31 is changed.

[The Case of Not Changing the Gamma Value]

Figure 7A:
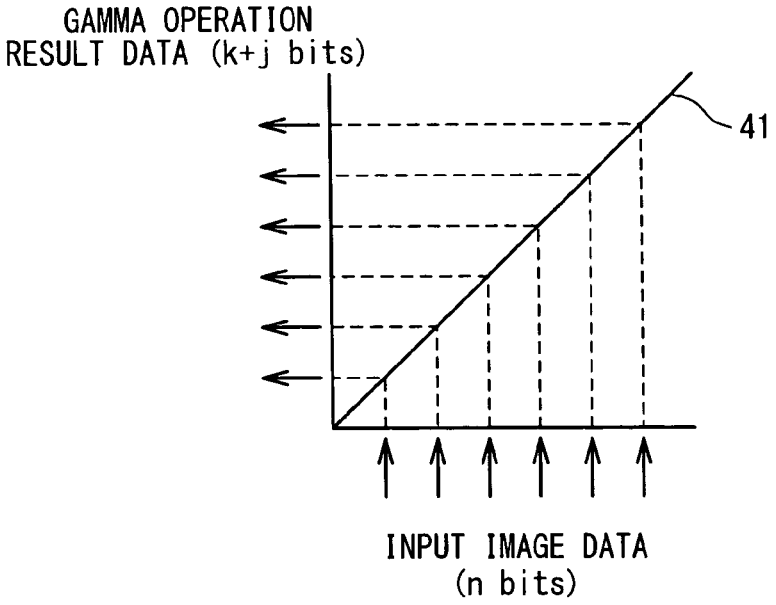
FIGS. 7A and 7B are views concretely exemplifying an operation of the gamma conversion section according to the first invention.

FIG. 7A is a graph showing a relationship between the input image data 31 and the gamma operation result data in the case where the gamma correction is not performed by the gamma operation circuit 11. The gamma operation circuit 11 generates the gamma operation result data so as to meet the operational expression shown in the graph 41 of FIG. 7A. Referring to FIG. 7A, the gamma operation circuit 11 outputs the gamma operation result data after performing the operation corresponding to the graph 41 in response to the input image data 31. The gamma operation circuit 11 supplies the higher order j bits to the LUT 12 as the higher order bit data 32.

Figure 7B:
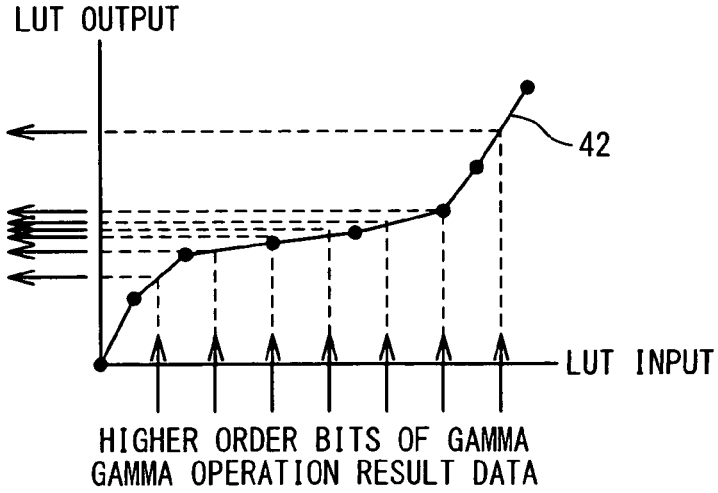

FIG. 7B is a graph showing a relationship between the gamma operation result data and the LUT output. A graph 42 corresponds to the VT data stored in the LUT 12. Referring to FIG. 7B, the LUT 12 refers to the VT data of the corresponding address in response to the higher order bit data 32 supplied from the gamma operation circuit 11. The LUT 12 supplies the VT data obtained due to the reference and the VT data of the address adjoining the corresponding address to the linear interpolation D/A converter 13 as the LUT output. As shown in FIG. 7B, the LUT 12 stores the VT data adapting the V-T characteristic of the liquid crystal display panel 2. For this reason, when the VT data is plotted in a graph, the VT data draws the curved line shown as the graph 42. Accordingly, the LUT output outputted from the LUT 12 is outputted as the data including the V-T characteristic of the liquid crystal display panel 2.

[The Case of Changing the Gamma Value]

Figure 8A:
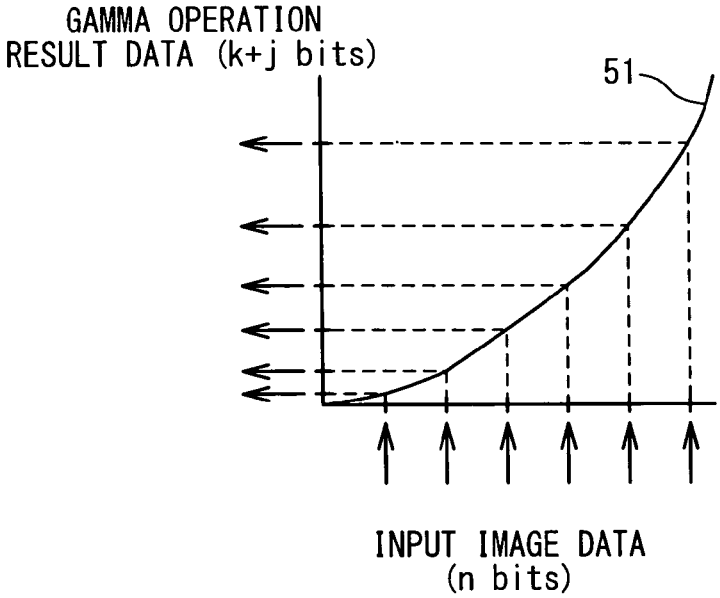
FIGS. 8A and 8B are views concretely exemplifying the operation of the gamma conversion section according to the first invention.

FIG. 8A is a graph showing a relationship between the input image data 31 and the gamma operation result data in the case where the gamma operation circuit 11 performs the gamma correction on the input image data 31. The gamma operation circuit 11 of the present embodiment changes the gamma correction operation in response to the gamma setting signal 37. For example, in FIG. 7A, when the gamma value of the input image data 31 is image data corresponding to $\gamma=2.2$, the gamma value of the higher order bit data 32 is also $\gamma=2.2$. When receiving the command for changing the gamma value of the higher order bit data 32 due to the gamma setting signal 37, the gamma operation circuit 11 calculates the gamma value $\gamma$ corresponding to following expression (3) in response to the command. Then, the gamma operation circuit 11 substitutes the calculated gamma value $\gamma$ to above-mentioned expression (1).

$$\text{(The gamma value } \gamma\text{)=(the changed gamma value)/(the basic gamma value)} \quad (3),$$

wherein the basic gamma value is the gamma value set in the LUT 12.

For example, when the $\gamma=2.2$ corresponding to the input image data 31 is set as the basic gamma value and the changed gamma value is required to be changed into 2.4, $$\text{(the gamma value } \gamma) = 2.4/2.2 = 1.090909.$$

When the input image data 31 is 8-bit data and the gamma operation result data is 10-bit data, by substituting the gamma value to the expression (1), $$\text{(The gamma operation result data)}=1020\times((\text{input image data})/255)^{1.090909}.$$

Referring to FIG. 8A, the gamma operation circuit 11 generates the gamma operation result data so as to meet the operational expression shown in a graph 51. The gamma operation circuit 11 outputs gamma operation result data after performing the operation corresponding to the graph 51 in response to the input image data 31. As shown in FIG. 8A, the gamma operation circuit 11 sets image data corresponding to the gamma value different from the input image data 31 to be the gamma operation result data. The gamma operation circuit 11 supplies the higher order j bits to the LUT 12 as the higher order bit data 32.

Figure 8B:
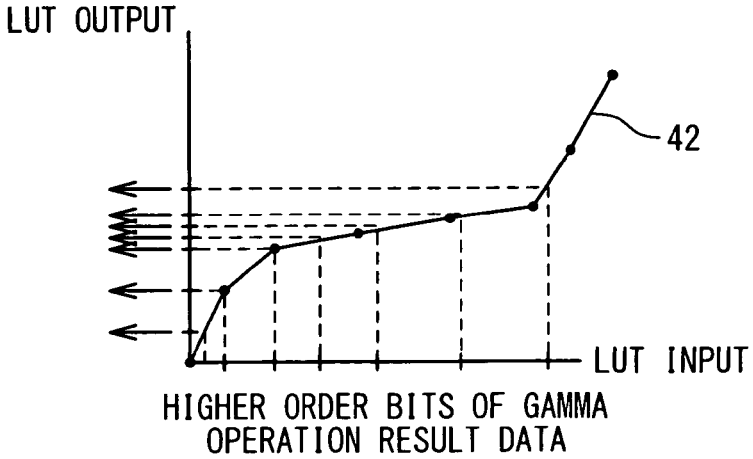

FIG. 8B is a graph showing a relationship between the gamma operation result data and the LUT output similar to FIG. 7B. The graph 42 corresponds to the VT data stored in the LUT 12. Referring to FIG. 8B, the LUT 12 refers to the VT data of a corresponding address in response to the higher order bit data 32 supplied from the gamma operation circuit 11. As described above, the higher order bit data 32 are higher order j bits data of image data corresponding to the gamma value different from the input image data 31. For this reason, lopsided data compared to the case shown in FIG. 7B are supplied as the higher order bit data 32. The LUT 12 corrects the higher order bit data 32 so that the higher order bit data 32 can adapt the V-T characteristic of the liquid crystal display panel 2.

As described above, the control driver 3 according to the present embodiment includes the gamma operation circuit 11, the LUT 12, the linear interpolate circuit 23, the linear DAC 24. The control driver 3 corrects the input image data by using the gamma operation circuit 11 and the LUT 12. After that, the linear interpolate circuit 23 and the linear DAC 24 perform linear interpolation on the corrected data and generate the output voltage for driving the data lines. As described above, the control driver 3 according to the present embodiment generates the output voltage without performing the subtractive color processing.

An operation of the control driver 3 according to the present embodiment will be explained below by exemplifying a case where a gamma correction is performed on 8-bit image data and the image data is expanded to be 10-bit image data. FIG. 9 is a table showing the grayscale-voltage characteristic of the liquid crystal display panel to which the control driver 3 according to the present embodiment can be applied. In this case, when the input grayscale data is 10 and the gamma=2.2 is corrected to the gamma=2.4 for example, it can be obtained based on above-mentioned expressions (1) and (3) that:

$$\text{(the output data)} = 1020 \times (10/255)^{2.4/2.2} = 29.8.$$

With respect to this value, 30-grayscale data in the 10-bit grayscale 63 is output after round-off processing. The LUT 12 according to the present embodiment refers to data in this higher order 6 bits. As shown in the 6-bit grayscale 65 in FIG. 9, the LUT 12 selects 1-grayscale data in the 6-bit grayscale 65 and 2-grayscale data in the 6-bit grayscale 65 due to the reference. The linear interpolation circuit 24 performs linear interpolation based on these values and data in the lower order 4 bits. Referring to FIG. 9, the output voltage (linear interpolation data 36) in this case is determined as:

$$\text{(the output voltage)} = 3.2 + (3.7 - 3.2) \times (16 - 14)/2^4 = 3.2625\ \text{V}.$$

When the gamma correction is performed on above-mentioned condition, the conventional liquid crystal display panel performs processing of extension to 10-bit image data on 8-bit image data even before input to the control driver. When having 8-bit input, the conventional control driver performs the subtractive color processing on the data extended up to 10 bits and supplies the data to the control driver. Specifically, when the input grayscale data is 10 and the gamma=2.2 is corrected to the gamma=2.4, the following operation is performed, $$\text{(the output data)} = 1023 \times (10/255)^{2.4/2.2} = 29.8,$$

30-grayscale data in 10-bit grayscale 63 is obtained after round-off processing. On this occasion, when the subtractive color processing performed later is processing for simply deleting lower order 2 bits, the 30-grayscale data in the 10-bit grayscale 63 is converted into 7-grayscale data (3.4V) in the 8-bit grayscale 64, (30>>2=7).

Referring to FIG. 9, actually, outputting of 7.5-grayscale data (3.3V) in the 8-bit grayscale 64 means the correction from the gamma 2.2 to the gamma 2.4. As described above, 3.4 V, however, is supplied to the conventional control driver in this case. Accordingly, an error of 0.1 V occurs. In addition, when the subtractive color processing such as a FRC (Frame Rate Control) or a dither method is performed, image deterioration because of the subtractive color processing occurs (if the FRC, a flicker occurs, and if the dither, a granular deterioration is caused).

However, the control driver in the present invention has obtained:

$$\text{(the output voltage)} = 3.2 + (3.7 - 3.2) \times (16 - 14)/2^4 = 3.2625\ \text{V},$$

as the output voltage when the gamma 2.2 is corrected to the gamma 2.4. As described above, the gamma correction is performed in a step of the 8-bit grayscale in the gamma correction of the conventional liquid crystal display panel, however, the control driver according to the present embodiment can output the voltage with an accuracy of the 10-bit grayscale. Accordingly, the control driver according to the present embodiment can reduce the error than the conventional technique.

Furthermore, the gamma operation circuit 11 changes gamma operation processing to be performed in response to the gamma setting signal 37 as described above. In addition, regardless of the gamma operation processing performed by the gamma operation circuit 11, the LUT 12 corrects the V-T characteristic without depending on the processing result. As described above, the gamma operation circuit 11 is configured by a circuit having a function for translating data such as a combinational circuit (or a sequential circuit). Thus, the gamma operation circuit can change other gamma values in real time when input image data corresponding to a specific gamma value is converted into data corresponding to another gamma value.

In addition, the LUT 12 is configured corresponding to the V-T characteristic of the liquid crystal display panel 2. The LUT 12 according to the present embodiment is stored in a rewritable memory. Accordingly, the control driver 3 according to the present embodiment can correspond to the liquid crystal display panel 2 having a different V-T characteristic by updating contents of the LUT 12.

In the control driver 3 according to the present embodiment, the input image data 31 is data of 8-bit data and the higher order bit data is 6-bit data for example, and the LUT 12 translates data by using the higher order bit data 32 of the 6-bit data. On this occasion (data input to the LUT 12 is 6-bit data), destruction of the data can be prevented by configuring the first LUT 21 and the second LUT 22 of the LUT 12 to be in 8 bits. After that, the linear interpolation circuit 23 of the present embodiment performs the linear interpolation on the first output data 34 and the second output data 35 by using the lower order bit data 33 of 4-bit data. In this case described above (the case where the first LUT 21 and the second LUT 22 are configured to be in 8 bits), the LUT 12 can be configured to be in:

$$8\text{ bits}\times 64\text{ grayscales}\times 2=1024\text{ bits}.$$

In a case where the aforementioned input image data 31 is processed by the conventional LUT, a condition of: 256 grayscales×10 bits=2560 bits are required. Accordingly, the control driver 3 of the present embodiment can reduce a memory capacity required for the LUT compared to the conventional control driver.

(Second Embodiment)

Figure 10:
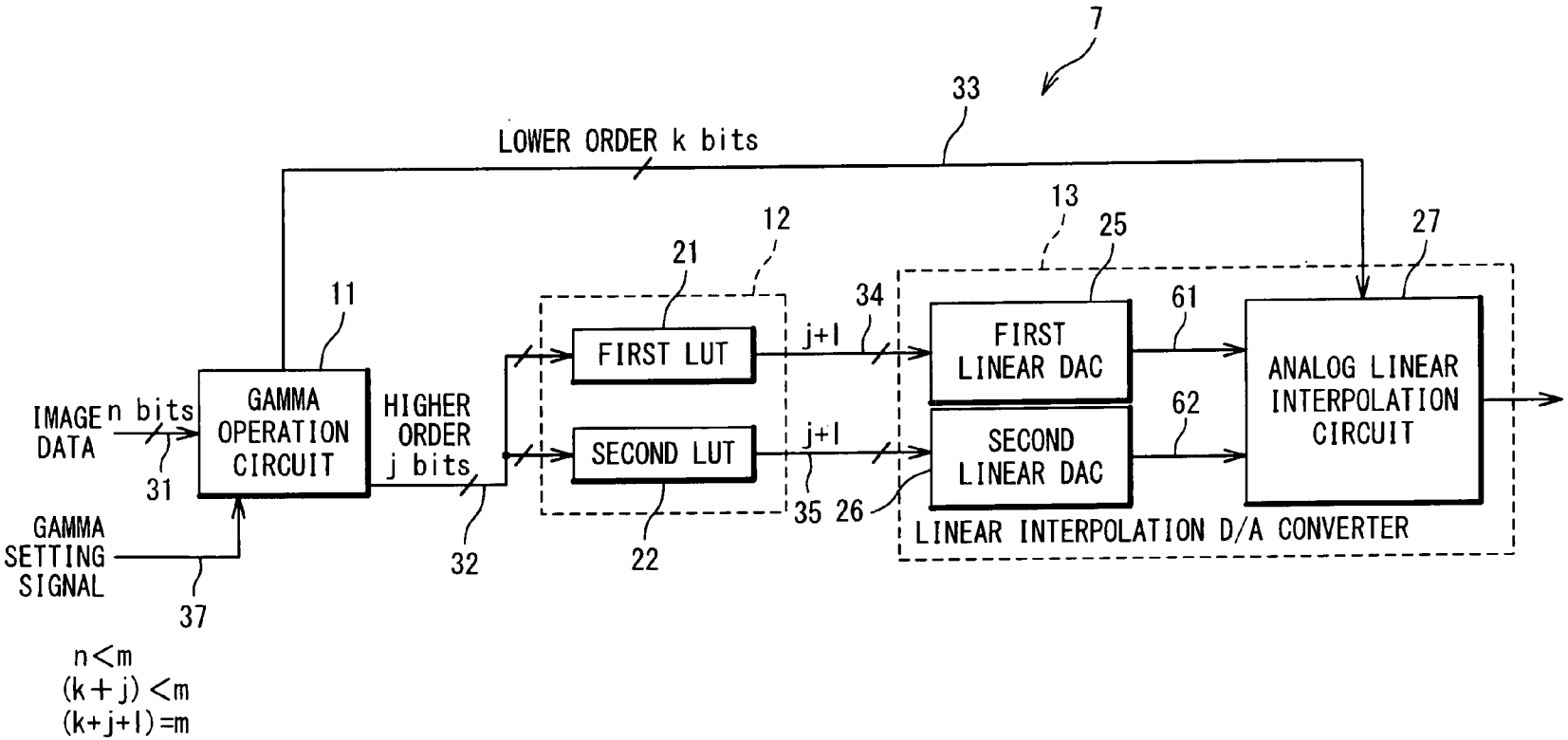
FIG. 10 is a block diagram exemplifying a configuration of a gamma conversion section according to a second embodiment.

Referring to drawings, a second embodiment according to the present invention will be explained below. FIG. 10 is a block diagram exemplifying a configuration of the second embodiment according to the present invention. Referring to FIG. 10, the linear interpolation D/A converter 13 of the second embodiment according to the present invention includes a first linear DAC 25, a second linear DAC 26, and an analog linear interpolation circuit 27.

The first linear DAC 25 and the second linear DAC 26 are circuits for converting input data (linear interpolation data) into a voltage based on the power source voltage supplied from the power source voltage generation circuit 9. Similar to the linear DAC 24, in the first linear DAC 25 and the second linear DAC 26, the input data and the output voltage are equally-weighted (linear). That is to say, the weight of the data input to the linear DACs 25, 26 and the weight of the voltage output from the linear DACs 25, 26 are constant. Accordingly, the first linear DAC 25 linearly outputs a first analog signal 61 in response to the first output data 34. Similarly, the second linear DAC 26 linearly outputs a second analog signal 62 in response to the second output data 35. The analog linear interpolation circuit 27 is a circuit for determining an intermediate voltage between the first analog signal 61 and the second analog signal 62.

In the second embodiment, the number of the power source voltages supplied from the power source voltage generation circuit 9 to the linear interpolation D/A converter 13 is $2^{j+l}$. The first linear DAC 25 supplies the first analog signal 61 selected by the first output data 34 among the $2^{j+l}$ power source voltages to the analog linear interpolation circuit 27. Similarly, the second linear DAC 26 supplies the second analog signal 62 selected by the second output data 35 among the $2^{j+l}$ power source voltages to the analog linear interpolation circuit 27.

As shown in FIG. 10, the analog linear interpolation circuit 27 generates an analog voltage value supplied for the data line drive circuit 8 by performing the linear interpolation on the first analog signal 61 and the second analog signal 62 on the basis of the lower order bit data 33 output from the gamma operation circuit 11.

The LUT 12 according to the present embodiment outputs the first output data 34 and the second output data 35 corresponding to the V-T characteristic to the linear interpolation D/A converter 13. That is to say, a weight of grayscale data and a weight of a voltage are proportional to each other in the first output data 34 and the second output data 35 output from the LUT 12. In the linear interpolation D/A converter 13 according to the second embodiment, both of the first linear DAC 25 and the second linear DAC 26 have a linear characteristic and the analog linear interpolation circuit 27 calculates an intermediate voltage between two voltages by an operation. Accordingly, the linear interpolation D/A converter 13 according to the second embodiment can generate an output voltage by an analog operation without depending on the V-T characteristic and based on the first output data 34 and the second output data 35 output from the LUT 12.

(Third Embodiment)

Referring to drawings, a third embodiment according to the present invention will be explained below. In the embodiments described above, the first LUT 21 and the second LUT 22 have one set of data corresponding to the bit number "j" of the higher order bit data 32 of the VT data (=higher order j×2 sets), respectively. In the embodiments described above, a gap of data output from the respective first LUT 21 and the second LUT 22 is interpolated. The gamma conversion section 7 according to the third embodiment is configured so as to perform an appropriate linear interpolation based on one set of the VT data corresponding to the bit number "j" of the higher order bit data 32 in order to downsize the LUT 12.

Figure 11:
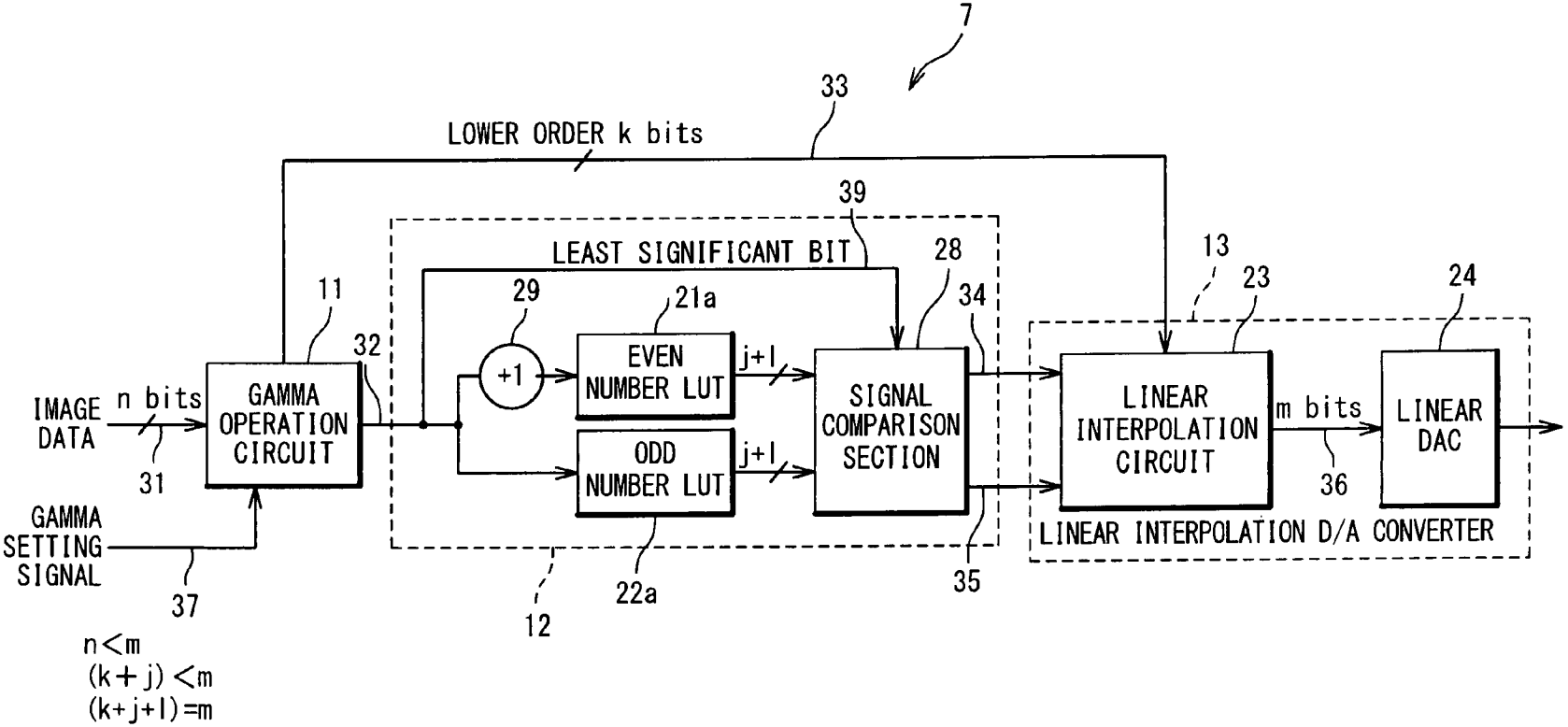
FIG. 11 is a block diagram exemplifying a configuration of a gamma conversion section according to a third embodiment.

FIG. 11 is a block diagram exemplifying a configuration of the third embodiment according to the present invention. The LUT 12 of the third embodiment includes an even number LUT 21*a*, an odd number LUT 22*a*, a signal comparison section 28, an adder 29. The adder 29 supplies a value to the even number LUT 21*a*, wherein the value is made by adding "1" to the higher order bit data 32. A value made by truncating the lower order 1 bit from the value made by adding "1" to a higher order bit data 32 is input to an address of the even number LUT 21*a*. In addition, a value made by truncating a lower order 1 bit from the higher order bit data 32 is input to an address of the odd number LUT 22*a*.

Furthermore, in the third embodiment, the signal comparison section 28 is provided to a subsequent part of the even number LUT 21*a* and the odd number LUT 22*a*. As shown in FIG. 11, the least significant bit 39 of the higher order bit data 32 is supplied to the signal comparison section 28. The signal comparison section 28 compares a size of the first output data 34 output from the even number LUT 21*a* with a size of the second output data 35 output from the odd number LUT 22*a* based on the least significant bit 39 of the higher order bit data 32. In a case where the least significant bit 39 of the higher order bit data 32 is "1" (the higher order bit data 32 is odd), the signal comparison section 28 determines that as: (the even number LUT output)>(the even number LUT output).

Similarly, in a case where the least significant bit 39 of the higher order bit data 32 is "0" (the higher order bit data 32 is even), the signal comparison section 28 determines that as: (the even number LUT output)<(the even number LUT output).

On this occasion, when it is required to alternate the odd number LUT output and the even number LUT output, the signal comparison section 28 alternates the odd number LUT output and the even number LUT output based on the least significant bit 39 and supplies them to the linear interpolation circuit 23. That is to say, the signal comparison section 28 supplies any of the even number LUT output and the odd number LUT output to the linear interpolation circuit 23 as the first output data 34 so as to perform the appropriate linear interpolation. Then, the signal comparison section 28 supplies the other to the linear interpolation circuit 23 as the second output data 35. The linear interpolation circuit 23 performs the linear interpolation on the first output data 34 and the second output data 35 output from the signal comparison section 28.

In the present embodiment, in order to realize the linear interpolation by using one set of the VT data corresponding to the bit number "j" of the higher order bit data 32, it is required to output a combination such as: for example, the 0-th VT data and the 1st VT data;

the 1st VT data and the 2nd VT data; and the 2nd VT data and the 3rd VT data.

Referring to drawings, a detailed configuration and an operation according to the present embodiment will be described below.

Figure 12A:
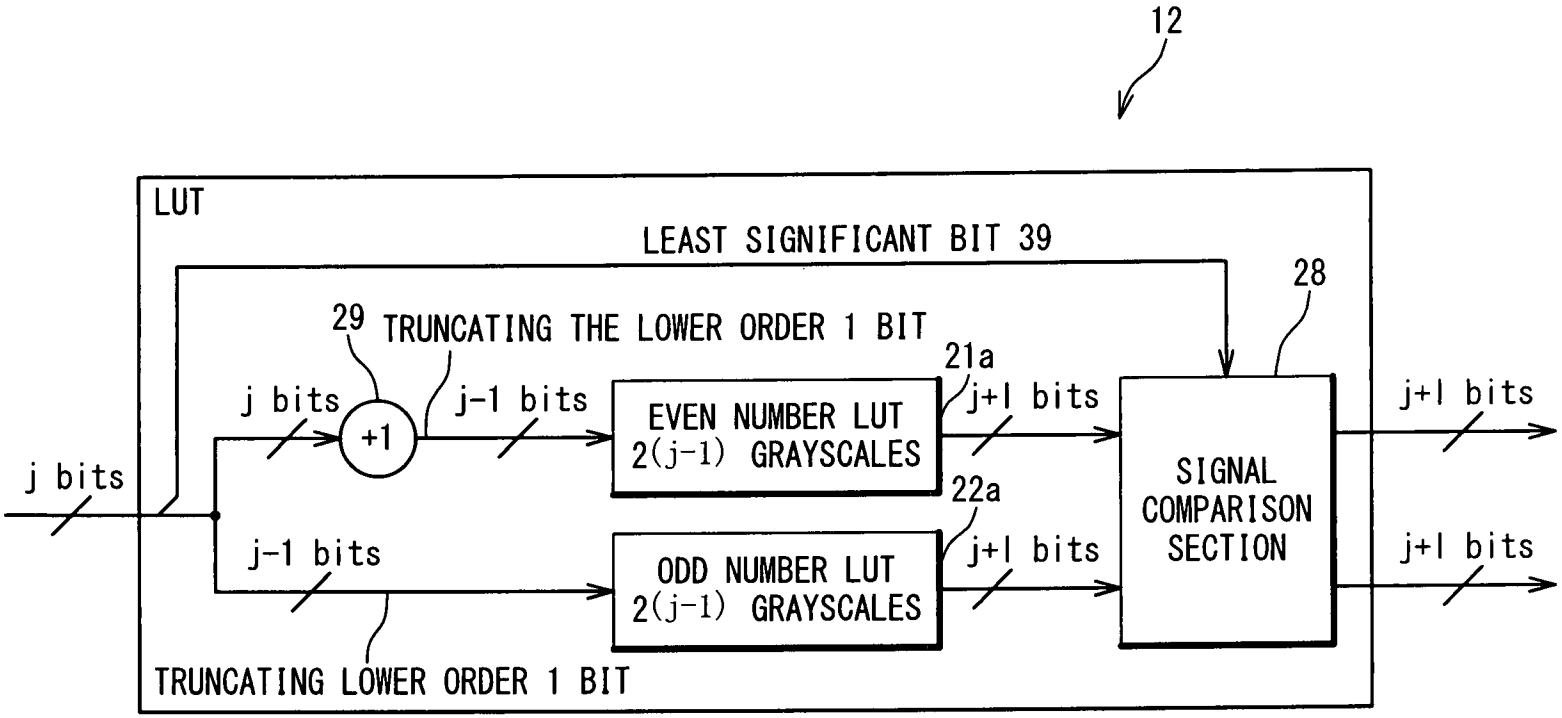
FIG. 12A is a view showing a configuration of the LUT according to the third embodiment.

FIG. 12A is a view exemplifying a configuration of the LUT 21 according to the third embodiment. FIG. 12B is a table exemplifying a configuration of the VT data stored in the even number LUT 21*a* and the odd number LUT 22*a* including the LUT 12 according to the third embodiment. As shown in FIG. 12B, when data corresponding to the bit number "j" of the higher order number bit data 32 are stored by being separated in two LUTs (the even number LUT 21*a* and the odd number LUT 22*a*), the data are separated as follows:

| Address | Odd number LUT | Even number LUT |
|---|---|---|
| 0 | 1st VT data | 0-th VT data |
| 1 | 3rd VT data | 2nd VT data |
| | ... | |
| $2^{(j-1)}-2$ | $(2^j-3)$-th VT data | $(2^j-4)$-th VT data |
| $2^{(j-1)}-1$ | $(2^j-1)$-th VT data | $(2^j-2)$-th VT data. |

As shown in FIG. 12A, in the LUT 12 according to the third embodiment, a condition, (higher order bit data+1)>>1, is given as an address input to the even number LUT 21*a* here. In addition, a condition, (higher order bit data)>>1, is given as an address input to the odd number LUT 22*a*. Accordingly, the LUT 12 according to the third embodiment can output not only a pair of the 0-th VT data and the 1st VT data and a pair of the 2nd VT data and the 3rd VT data but also a pair of the 1st VT data and the 2nd VT data.

The signal comparison section 28 performs interpolation on the output two VT data by using lower bits (the least significant bit 39 of the higher order bit data 32) on which the gamma operation has been operated. According to this configuration and operation, the control driver 3 of the third embodiment can interpolate data whose bit number is extended by the gamma operation with using values meeting the VT characteristic of the liquid crystal. That is to say, the control driver 3 of the third embodiment can perform the gamma operation meeting the VT characteristics of various liquid crystal panels and can output bit-extended data as the voltage applied to the liquid crystal.

Figure 13A:
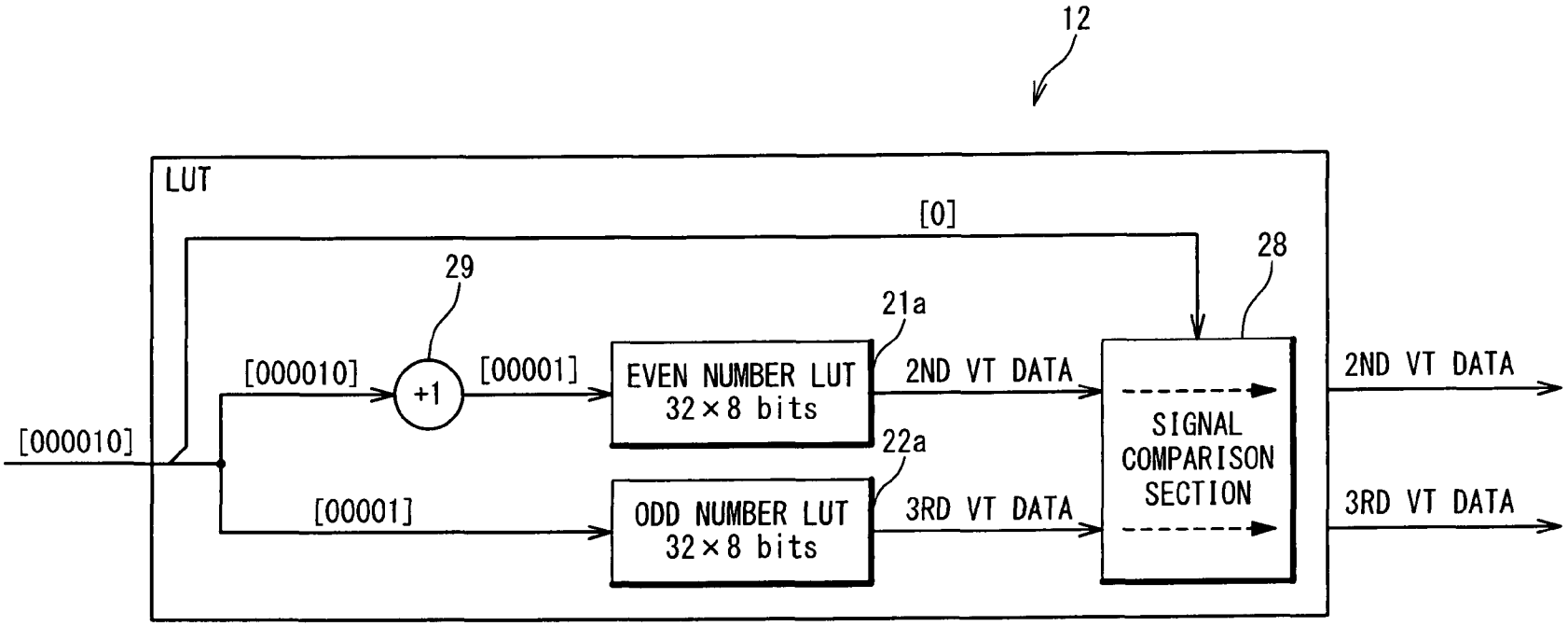
FIG. 13A is a view exemplifying an operation of the LUT according to the third embodiment.

The third embodiment will be explained by using specific numerical values below. FIGS. 13A and B are views exemplifying an operation and a table of a case where 2 ("6'b000010") is input as the higher order bit data 32. Referring to FIG. 13A, when 2 is input as the higher order bit data 32, $$(6'b000010 + 6'000001) >> 1 = 5'b00001 = 1$$

is input to an address of the even number LUT 21*a*.

As shown in FIG. 13B, when 1 is input to the address of the even number LUT 21*a*, the even number LUT 21*a* outputs the 2nd VT data. Similarly, as shown in FIG. 13A, when 2 is input as the higher order bit data 32, $$(6'b000010) >> 1 = 5'b00001 = 1$$

is input to an address of the odd number LUT 22*a*. Accordingly, as shown in FIG. 13B, when 1 is input to the address of the odd number LUT 22*a*, the odd number LUT 22*a* outputs the 3rd VT data.

Referring to FIG. 13A, since the least significant bit 39 of the higher order bit data 32 is 0 on this occasion, the signal comparison section 28 sets the 2nd VT data to be the first output data 34 (the first LUT output) and sets the 3rd VT data to be the second output data 35 (the second LUT output) without alternating the odd number LUT data and the even number LUT data, and supplies the data to the linear interpolation D/A converter 13.

Figure 14A:
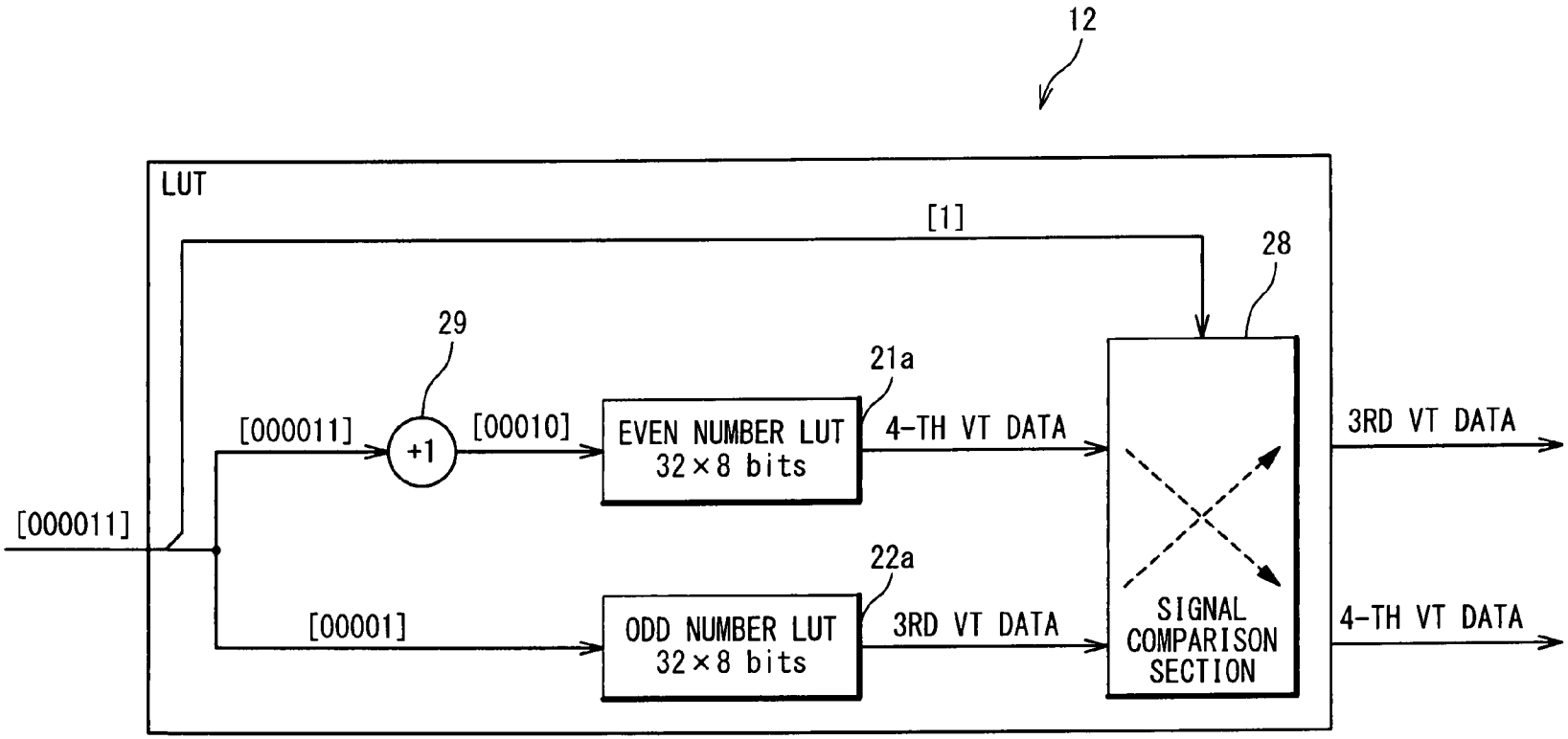
FIG. 14A is a view exemplifying an operation of the LUT according to the third embodiment.

FIGS. 14A and 14B are views exemplifying an operation and a table of a case where 3 ("6'b000011") is input as the higher order bit data 32. Referring to FIG. 14A, when 3 is input as the higher order bit data 32, (3+1)/2=2 is input to an address of the even number LUT 21*a*.

As shown in FIG. 14B, when 2 is input to the address of the even number LUT 21*a*, the even number LUT 21*a* outputs the 4-th VT data. On this occasion, 1 is input to an address of the odd number LUT 22*a* as shown in FIG. 14A, and the odd number LUT 22*a* outputs the 3rd VT data thereby as shown in FIG. 14B.

Referring to FIG. 14A here, the least significant bit 39 of the higher order bit data is 1. Accordingly, the signal comparison section 28 alternates the odd number LUT data and the even number LUT data, and sets the 3rd VT data to be the first output data 34 (the first LUT output) and the 4-th VT data to be the second output data 35 (the second LUT output) and supplies them to the linear interpolation D/A converter 13.

Herewith, using one set of the VT data, the LUT 12 according to the third embodiment can output data required for interpolating the VT data. In addition, a size of the LUT 12 can be:

8 bits×(even number 32 grayscales)+8 bits×(odd number 32 grayscales)=512 bits.

Meanwhile, the signal comparison section 28 may have a configuration for comparing the even number LUT output and odd number LUT output each other without using the least significant bit 39. In this case, the signal comparison section 28 outputs the larger output as the first output data and outputs the smaller output as the second output data 35.

(Fourth Embodiment)

Figure 15:
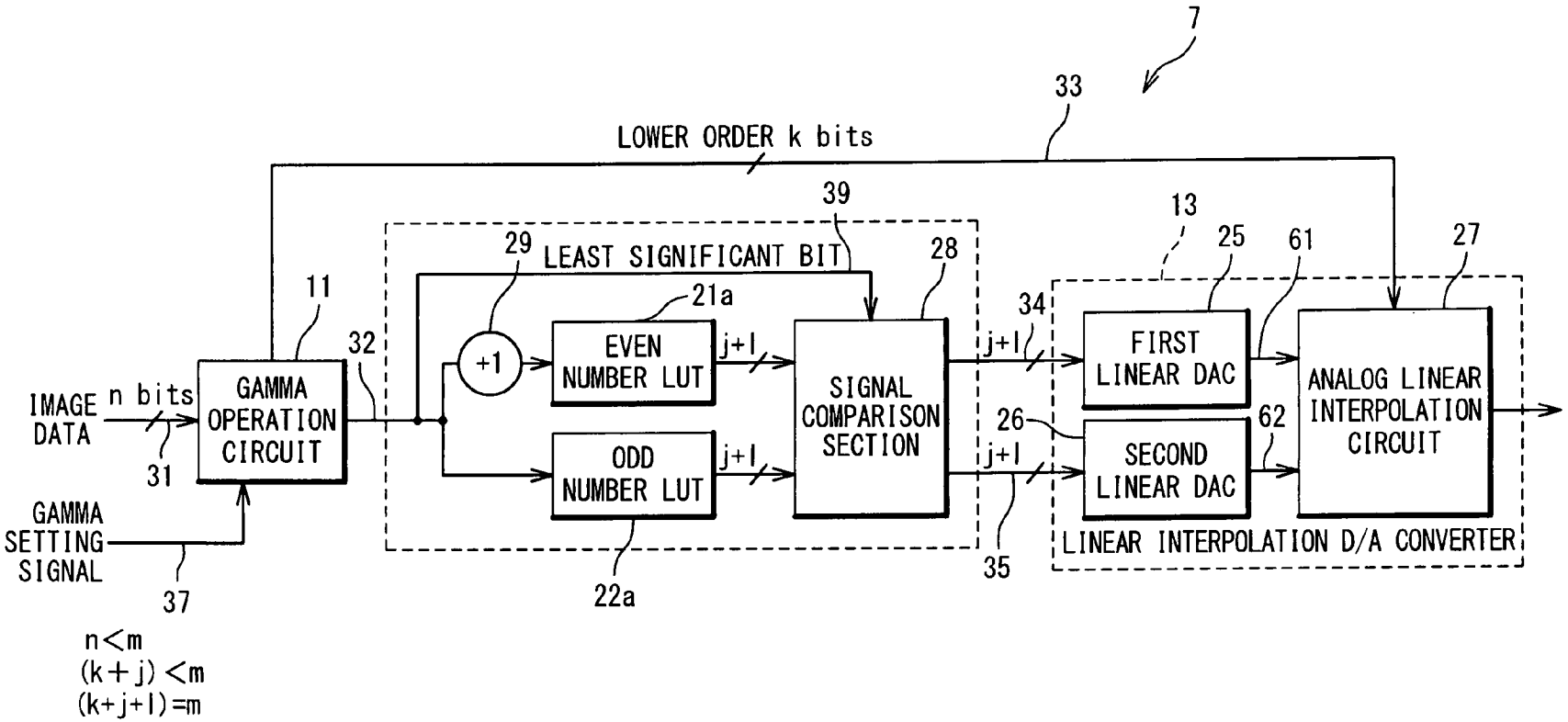
FIG. 15 is a block diagram exemplifying a configuration of a gamma conversion section according to a fourth embodiment.

Referring to drawings, a fourth embodiment according to the present invention will be explained below. FIG. 15 is a block diagram exemplifying a configuration of the gamma conversion section 7 according to the fourth embodiment. The gamma conversion section 7 according to the fourth embodiment has a configuration for performing an appropriate linear interpolation due to one set of VT data corresponding to the bit number "j" of the higher order bit data 32. Referring to FIG. 15, the LUT 12 of the gamma conversion section 7 of the fourth embodiment has a configuration similar to the LUT 12 of the third embodiment. In addition, the linear interpolation D/A converter 13 of the gamma conversion section 7 in the fourth embodiment has a configuration similar to that of the second embodiment.

In the present embodiment, the first output data 34 and the second output data 35 are supplied to the linear interpolation D/A converter 13 by the operation similar to that of aforementioned third embodiment. The first linear DAC 25 of the linear interpolation D/A converter 13 supplies the first analog signal 61 selected by the first output data 34 among the $2^{j+l}$ power source voltages to the analog linear interpolation circuit 27. Similarly, the second linear DAC 26 supplies the second analog signal 62 selected by the second output data 35 among the $2^{j+l}$ power source voltages to the analog linear interpolation circuit 27.

Herewith, the gamma conversion section 7 of the fourth embodiment can realize the linear interpolation based on one set of the VT data corresponding to the bit number "j" of the higher order bit data 32. The linear interpolation D/A converter 13 can generate an output voltage by an analog operation without depending on the V-T characteristic based on the first output data 34 and the second output data 35 output from the LUT 12.

In a plurality of aforementioned embodiments, the gamma operation circuit 11 performs operation processing (the gamma operation processing) for converting the input image data 31 corresponding to a certain gamma value into data corresponding to another gamma value (the operation result data). Since the gamma operation circuit 11 performs the gamma operation processing without depending on the V-T characteristic of the liquid crystal display panel 2, the operation result data, data corresponding to a changed gamma value is uniquely determined when the changed gamma value is determined. For this reason, when the changed gamma value is determined, the gamma operation circuit 11 can be formed of combinational circuits (or sequential circuits), the gamma operation circuit 11 having a small circuit size can be configured without including the LUT.

In addition, in a plurality of aforementioned embodiments, the gamma operation circuit 11 includes a configuration which can change the changed gamma value in real time in response to the gamma selection signal 37. Accordingly, a condition in displaying an image can be rapidly changed according to a change of a surrounding environment of the liquid crystal display device 1.

In addition, in a plurality of aforementioned embodiments, data output from the gamma operation circuit 11 (gamma operation result data) is extended more than the bit number of the input image data 31. As described above, the linear interpolation is performed on two data corresponding to the expanded bit number in correction processing in the LUT 12. Consequently, the control driver 3 in the present invention, an output voltage can be provided to the data line drive circuit 8 without performing the subtractive color processing.

In addition, in the present embodiment, the subtractive color processing may be performed. In the control driver of the conventional liquid crystal display, a correction of the V-T characteristic is performed after performing the subtractive color processing. Accordingly, errors corresponding to values incorporated in the LUT have occurred in the conventional control driver. In above mentioned embodiments, when the control driver 3 performs the subtractive color processing, the subtractive color processing is performed after performing the linear interpolation. In this case, the error after the subtractive color processing corresponds to a value made by performing the linear interpolation on data output from the LUT. Consequently, the error can be smaller than that of the conventional control driver.

It is apparent that the present invention is not limited to the above embodiment, but may be modified and changed without departing from the scope and spirit of the invention.

What is claimed is:

1. A control driver for a liquid crystal display panel comprising:

an operation circuit configured to perform a certain operation on input image data to generate operation data, and output higher order bit data and lower order bit data of said operation data;

an LUT (Look-up Table) configured to include a V-T (Voltage-Transmittance) characteristic of said liquid crystal display panel, and output first output data and second output data as display data based on said higher order bit data and said V-T characteristic; and a linear interpolation D/A converter configured to perform a linear interpolation operation and a D/A conversion to generate output voltage supplied to said liquid crystal display panel in response to said first output data, said second output data and said lower order bit data, wherein said operation circuit performs a gamma operation which converts said input image data corresponding to a certain gamma value into image data corresponding to another gamma value to obtain gamma operation result data, and outputs said gamma operation result data as said operation data, wherein said operation circuit performs said gamma operation without depending on the V-T characteristic of the liquid crystal display panel, and wherein the operation circuit is configured to change said certain gamma value in real time in response to a gamma selection signal.

2. The control driver according to claim 1, wherein said linear interpolation D/A converter includes:

a linear interpolation section configured to perform a linear interpolation between said first output data and said second output data based on said lower order bit data to generate digital linear interpolation data, and a linear DAC configured to perform a D/A conversion on said digital linear interpolation data to generate said output voltage which is linear to said digital linear interpolation data.

3. The control driver according to claim 2, wherein said operation circuit changes said another gamma value in response to a gamma setting signal supplied from an outside of said control driver.

4. The control driver according to claim 3, wherein said LUT is stored in a rewritable memory and updated in response to a command supplied from an outside of said control driver.

5. The control driver according to claim 4, wherein said LUT includes:

a first LUT; and a second LUT, wherein each of said first LUT and said second LUT has addresses, a number of said addresses corresponds to a bit number of said higher order bit data, wherein said first LUT stores n-th (n is an arbitrary integer) correction data in an n-th address, and wherein said second LUT stores said n-th correction data in one of an (n+1)-th address and an (n−1)-th address.

6. The control driver according to claim 5, wherein when a bit number of said input image data is N, the bit number of said higher order bit data is J, a bit number of said lower order bit data is K, a bit number of said first output data is J +L, a bit number of said second output data is J +L, and a bit number of said digital linear interpolation data is M, said N, J, K, L and M meet following expressions (1) to (3), $$N<M \quad (1),$$

$$(K+J)<M \quad (2),$$

$$(K+J+L)=M \quad (3).$$

7. The control driver according to claim 4, further comprising:

a signal comparison section configured to receive said first output data and said second output data, wherein said LUT includes:

an odd number LUT configured to include correction data corresponding to a value truncating least significant bit data from said higher order bit data; and an even number LUT configured to include correction data corresponding to a value truncating least significant bit data from said higher order bit data, wherein said odd number LUT outputs data in an address corresponding to said value truncating the least significant bit data from said higher order bit data as said first output data, wherein said even number LUT outputs data in an address corresponding to said value truncating the least significant bit data from said higher order bit data plus one as said second output data, and wherein said signal comparison section alternates said first output data and said second output data based on the least significant bit data of said higher order bit data.

8. The control driver according to claim 7, wherein when a bit number of said input image data is N, a bit number of said higher order bit data is J, a bit number of said lower order bit data is K, a bit number of said first output data is J+L, a bit number of said second output data is J+L, and a bit number of said digital linear interpolation data is M, said N, J, K, L and M meet following expressions (1) to (3), $$N<M \quad (1),$$

$$(K+J)<M \quad (2),$$

$$(K+J+L)=M \quad (3).$$

9. The control driver according to claim 4, wherein said LUT has addresses, a number of the addresses corresponds to a number of data of said higher order bit data, and wherein said LUT refers to data included in said LUT in response to said higher order bit data, and supplies a data in a first address corresponding to said higher order bit data as said first output data and a data in a second address adjoining said first address as said second output data due to a reference to said linear interpolation D/A converter.

10. The control driver according to claim 9, wherein when a bit number of said input image data is N, a bit number of said higher order bit data is J, a bit number of said lower order bit data is K, a bit number of said first output data is J+L, a bit number of said second output data is J+L, and a bit number of said digital linear interpolation data is M, said N, J, K, L and M meet following expressions (1) to (3), $$N<M \quad (1),$$

$$(K+J)<M \quad (2),$$

$$(K+J+L)=M \quad (3).$$

11. The control driver according to claim 1, wherein said linear interpolation D/A converter includes:

a first linear DAC configured to generate a first analog signal in response to said first output data, wherein said first analog data is linear to said first output data;

a second linear DAC configured to generate a second analog signal in response to said second output data, wherein said second analog data is linear to said second output data; and an analog linear interpolation section configured to perform a linear interpolation on said first analog signal and said second analog signal based on said lower order bit data to generate said output voltage.

12. The control driver according to claim 11, wherein said operation circuit changes said another gamma value in response to a gamma setting signal supplied from an outside of said control driver.

13. The control driver according to claim 12, wherein said LUT is stored in a rewritable memory and updated in response to a command supplied from an outside of said control driver.

14. The control driver according to claim 13, wherein said LUT includes:

a first LUT; and a second LUT, wherein each of said first LUT and said second LUT has addresses, a number of said addresses corresponds to a bit number of said higher order bit data, wherein said first LUT stores n-th (n is an arbitrary integer) correction data in an n-th address, and wherein said second LUT stores said n-th correction data in one of an (n+1)-th address and an (n−1)-th address.

15. The control driver according to claim 1, wherein said operation circuit includes a combinational circuit.

16. A liquid crystal display device comprising:

a liquid crystal display panel; and a control driver configured to drive said liquid crystal display panel, wherein said control driver includes:

an operation circuit configured to perform a certain operation on input image data to generate operation data, and output higher order bit data and lower order bit data of said operation data;

an LUT (Look-up Table) configured to include a V-T (Voltage-Transmittance) characteristic of said liquid crystal display panel, and output first output data and second output data as display data based on said higher order bit data and said V-T characteristic; and a linear interpolation D/A converter configured to perform a linear interpolation operation and a D/A conversion to generate output voltage supplied to said liquid crystal display panel in response to said first output data, said second output data and said lower order bit data, wherein said operation circuit performs a gamma operation which converts said input image data corresponding to a certain gamma value into image data corresponding to another gamma value to obtain gamma operation result data, and outputs said gamma operation result data as said operation data, wherein said operation circuit performs said gamma operation without depending on the V-T characteristic of the liquid crystal display panel, and wherein the operation circuit is configured to change said certain gamma value in real time in response to a gamma selection signal.

17. The liquid crystal display device according to claim 16, wherein said linear interpolation D/A converter includes:

a linear interpolation section configured to perform a linear interpolation between said first output data and said second output data based on said lower order bit data to generate digital linear interpolation data, and a linear DAC configured to perform a D/A conversion on said digital linear interpolation data to generate said output voltage which is linear to said digital linear interpolation data.

18. The liquid crystal display device according to claim 17, wherein said operation circuit changes said another gamma value in response to a gamma setting signal supplied from an outside of said control driver.

19. The liquid crystal display device according to claim 18, wherein said LUT is stored in a rewritable memory and updated in response to a command supplied from an outside of said control driver.

20. The liquid crystal display device according to claim 19, wherein said LUT includes:

a first LUT; and a second LUT, wherein each of said first LUT and said second LUT has addresses, a number of said addresses corresponds to a bit number of said higher order bit data, wherein said first LUT stores n-th (n is an arbitrary integer) correction data in an n-th address, and wherein said second LUT stores said n-th correction data in one of an (n+1)-th address and an (n−1)-th address.

21. The liquid crystal display device according to claim 17, wherein said operation circuit includes a combinational circuit.

22. The liquid crystal display device according to claim 16, wherein said liquid crystal display panel is one of a plurality of liquid crystal display panels, and wherein said LUT is configured to include a V-T (Voltage-Transmittance) characteristic of each of said plurality of liquid crystal display panels.

23. The liquid crystal display device according to claim 16, wherein said control driver is configured such that the V-T characteristic of said liquid crystal display panel is written in the LUT and thereafter said LUT is not rewritten, and wherein said gamma operation is conducted without rewriting said LUT.

24. The liquid crystal display device according to claim 1, wherein said operation circuit performs said gamma operation independent of said LUT.

25. The liquid crystal display device according to claim 1, wherein said LUT receives said higher order bit data after said gamma operation is performed.

* * * * *